US008884824B2

(12) United States Patent
Andrenko

(10) Patent No.: US 8,884,824 B2
(45) Date of Patent: Nov. 11, 2014

(54) PLANAR INVERTED-F ANTENNA

(75) Inventor: Andrey Andrenko, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 181 days.

(21) Appl. No.: 13/703,604

(22) PCT Filed: Jun. 28, 2010

(86) PCT No.: PCT/JP2010/004266

§ 371 (c)(1),
(2), (4) Date: Dec. 11, 2012

(87) PCT Pub. No.: WO2012/001729

PCT Pub. Date: Jan. 5, 2012

(65) Prior Publication Data

US 2013/0271325 A1 Oct. 17, 2013

(51) Int. Cl.

| | |
|---|---|
| ***H01Q 1/04*** | (2006.01) |
| ***H01Q 5/00*** | (2006.01) |
| ***H01Q 9/04*** | (2006.01) |
| ***H01Q 1/52*** | (2006.01) |
| ***H01Q 9/42*** | (2006.01) |
| ***H01Q 1/24*** | (2006.01) |
| ***H01Q 21/28*** | (2006.01) |

(52) U.S. Cl.

CPC ..... *H01Q 9/04* (2013.01); *H01Q 9/0421* (2013.01); *H01Q 5/0072* (2013.01); *H01Q 1/521* (2013.01); *H01Q 9/42* (2013.01); *H01Q 1/243* (2013.01); *H01Q 21/28* (2013.01)

USPC ..... 343/700 MS; 343/767; 343/702

(58) Field of Classification Search

CPC ..... H01Q 1/521; H01Q 5/0072; H01Q 9/04; H01Q 9/42; H01Q 21/28; H01Q 9/0421; H01Q 1/243; H01Q 9/0407

See application file for complete search history.

(56) References Cited

U.S. PATENT DOCUMENTS

| | | | | |
|---|---|---|---|---|
| 6,476,769 | B1 * | 11/2002 | Lehtola | 343/702 |
| 6,683,575 | B2 * | 1/2004 | Sekine et al. | 343/702 |
| 6,788,257 | B2 * | 9/2004 | Fang et al. | 343/700 MS |
| 6,836,246 | B1 * | 12/2004 | Kadambi et al. | 343/700 MS |
| 6,943,746 | B2 | 9/2005 | Talvitie et al. | |
| 7,671,804 | B2 * | 3/2010 | Zhang et al. | 343/700 MS |
| 7,671,808 | B2 * | 3/2010 | Boyle | 343/702 |
| 2002/0126052 | A1 | 9/2002 | Boyle | |
| 2002/0180650 | A1 * | 12/2002 | Pankinaho et al. | 343/702 |
| 2006/0044186 | A1 | 3/2006 | Coppi et al. | |
| 2006/0176223 | A1 * | 8/2006 | Ishimiya | 343/702 |
| 2009/0040109 | A1 | 2/2009 | Iguchi et al. | |
| 2012/0019420 | A1 * | 1/2012 | Caimi et al. | 343/702 |

FOREIGN PATENT DOCUMENTS

| | | | |
|---|---|---|---|
| JP | 2006-295876 | A | 10/2006 |
| JP | 2009-206847 | A | 9/2009 |
| WO | WO 2004/015810 | A1 | 2/2004 |
| WO | WO 2004/038857 | A1 | 5/2004 |
| WO | WO 2010/047032 | A1 | 4/2010 |

* cited by examiner

*Primary Examiner* — Trinh Dinh

(74) *Attorney, Agent, or Firm* — Arent Fox LLP

(57) ABSTRACT

The planar inverted-F antenna for multi-band operation is compact while achieving good decoupling performance between feed ports for different frequency bands. The antenna has a ground plane (100); a radiating element having substantially a U-shape; first and second shorting elements (31, 32) located at a first corner (10*s*) of the radiating element (10) or adjacent area thereof; and first and second feed ports (P1, P2) electrically connected to the radiating element.

5 Claims, 23 Drawing Sheets

Calculated return loss (S-11,S-22) and port isolation (S-12)

| | |
|---|---|
| Type | Farfield |
| Approximation | enabled (kR >> 1) |
| Monitor | farfield (f=0.95) [1] |
| Component | Abs |
| Output | Gain |
| Frequency | 0.95 |
| Rad. effic. | -0.6991 dB |
| Tot. effic. | -2.293 dB |
| Gain | 1.387 dB |

Far-field 3D gain pattern at 950 MHz for the port P1 excitation

| | |
|---|---|
| Type | Farfield |
| Approximation | enabled (kR >> 1) |
| Monitor | farfield (f=1.95) [2] |
| Component | Abs |
| Output | Gain |
| Frequency | 1.95 |
| Rad. effic. | -0.007769 dB |
| Tot. effic. | -0.5468 dB |
| Gain | 3.707 dB |

Far-field 3D gain pattern at 1.95 MHz for the port P2 excitation

PLANAR INVERTED-F ANTENNA

CROSS-REFERENCE TO RELATED APPLICATION

This application is a National Stage entry of International Application No. PCT/JP2010/004266 filed Jun. 28, 2010, the disclosure of the prior application is hereby incorporated in its entirety by reference.

TECHNICAL FIELD

The present invention relates to a planar inverted-F antenna, in particular, for multi-band operation in wireless communication systems.

BACKGROUND ART

Mobile stations that communicate with wireless networks are frequently required to operate in different frequency bands. Different frequency bands may be used, for example, in different geographical regions, for different wireless providers, and for different wireless network systems. Mobile stations therefore often require an internal antenna responsive to multiple frequency bands including a lower frequency band, such as GSM850/900 band (824 to 960 MHz), and a higher frequency band, such as DCS (1710 to 1850 MHz), PCS (1850 to 1990 MHz) and UMTS (1920 to 2170 MHz).

Among the various choices for internal antennas in mobile stations, planar inverted-F antenna (PIFA) has been often adopted in practical application. Relative to other internal antennas, the PIFA is generally lightweight, easy to adapt and integrate into a device, and has moderate range of bandwidth. Conventional designs of PIFA for dual-band operation are disclosed in Japanese Laid-open Patent Publication No. 2006-295876, International Publication Pamphlet No. WO 2004/015810 A1, and International Publication Pamphlet WO 2004/038857 A1, for example.

CITATION LIST

Patent Literature

[PTL 1]
Japanese Laid-open Paten Publication No. 2006-295876
[PTL 2]
International Publication Pamphlet No. WO 2004/015810 A1
[PTL 3]
International Publication Pamphlet No. WO 2004/038857 A1

SUMMARY OF INVENTION

Technical Problem

In the above mentioned conventional designs of PIFA for dual-band operation, two or more separate antennas are arranged on a plane or a substrate for a low frequency band (i.e., GSM) and a high frequency band (i.e., UMTS), thereby achieving good decoupling performance (good isolation) between feed ports for the frequency bands. However, in the conventional arrangement of two isolated antennas, there exists a disadvantage of losing compactness of the overall antenna design, because two isolated radiators are arranged to be well separated to ensure a desired decoupling performance.

In consideration of the above, it would be apparent to those skilled in the art that there is a need for a planar inverted-F antenna of a compact design for multi-band operation while achieving good decoupling performance between feed ports for different frequency bands.

Solution to Problem

According to a first aspect of the invention, a planar inverted-F antenna, the antenna comprises: a ground plane; a radiating element; first and second shorting elements; a first feed port; and a second feed port. The radiating element is spaced from the ground plane and extending substantially parallel thereto. The radiating element has substantially a U-shape including a first part, a second part, and a third part, the first part extending from a first corner of the radiating element to a second corner of the radiating element, the second part extending from the second corner to a free end of the radiating element, and the third part extending from the first corner to the other free end of the radiating element. The first and second shorting elements are located at the first corner of the radiating element or adjacent area thereof. The first and second shorting elements electrically connect the radiating element to the ground plane. The first feed port is electrically connected to the first part of the radiating element, and is spaced from the first shorting element. The second feed port is electrically connected to the third part of the radiating element, and is spaced from the second shorting element.

Advantageous Effects of Invention

The disclosed planar inverted-F antenna has a compact design for multi-band operation while achieving good decoupling performance between feed ports for different frequency bands.

BRIEF DESCRIPTION OF DRAWINGS

Referring now to the attached drawings which form a part of this original disclosure:

FIG. 1 illustrates a perspective view of the planar inverted-F antenna according to the first embodiment;

FIG. 2 illustrates a plan view of the planar inverted-F antenna according to the first embodiment;

FIG. 3 illustrates an enlarged view of a plan view of a portion of the planar inverted-F antenna according to the first embodiment;

FIG. 4 illustrates an example of calculated S-parameters of the PIFA according to the first embodiment;

FIG. 5 illustrates a perspective view of the planar inverted-F antenna according to the second embodiment;

FIG. 6 illustrates a plan view of the planar inverted-F antenna according to the second embodiment;

FIG. 7 illustrates an enlarged view of a plan view of a portion of the planar inverted-F antenna according to the second embodiment;

FIG. 8 illustrates an example of calculated S-parameters of the PIFA according to the second embodiment;

FIG. 9 illustrates a perspective view of the planar inverted-F antenna according to the third embodiment;

FIG. 10 illustrates a plan view of the planar inverted-F antenna according to the third embodiment;

FIG. 11 illustrates an enlarged view of a plan view of a portion of the planar inverted-F antenna according to the third embodiment;

FIG. 12 illustrates an example of calculated S-parameters of the PIFA according to the third embodiment;

FIG. 13 illustrates a variation of the radiating element of the planar inverted-F antenna according to the embodiment;

FIG. 14 illustrates a far-field 3D gain pattern under the feed port P1 excitation at 950 MHz;

FIG. 15 illustrates a gain pattern at a specified plane under the feed port P1 excitation at 950 MHz;

FIG. 16 illustrates a gain pattern at a specified plane under the feed port P1 excitation at 950 MHz;

FIG. 17 illustrates a far-field 3D gain pattern under the feed port P2 excitation at 1.95 GHz;

FIG. 18 illustrates a gain pattern at a specified plane under the feed port P2 excitation at 1.95 GHz;

FIG. 19 illustrates a gain pattern at a specified plane under the feed port P2 excitation at 1.95 GHz;

FIG. 20 illustrates a simulation result of distribution of surface current (peak) in vector format in the exemplary PIFA (feed port P2 excitation at 950 MHz);

FIG. 21 illustrates a simulation result of distribution of surface current (peak) in vector format in the exemplary PIFA (feed port P1 excitation at 950 MHz);

FIG. 22 illustrates a simulation result of distribution of surface current (peak) in vector format in the exemplary PIFA (feed port P2 excitation at 1.95 GHz); and

FIG. 23 illustrates a simulation result of distribution of surface current (peak) in vector format in the exemplary PIFA (feed port P1 excitation at 1.95 GHz).

DESCRIPTION OF EMBODIMENTS

Preferred embodiments of a planar inverted-F antenna are now explained with references to the drawings. It is to be understood that both the foregoing general description and the following detailed description are exemplary and explanatory and are not to limit the scope of the invention.

(1) First Embodiment

Figure 1:
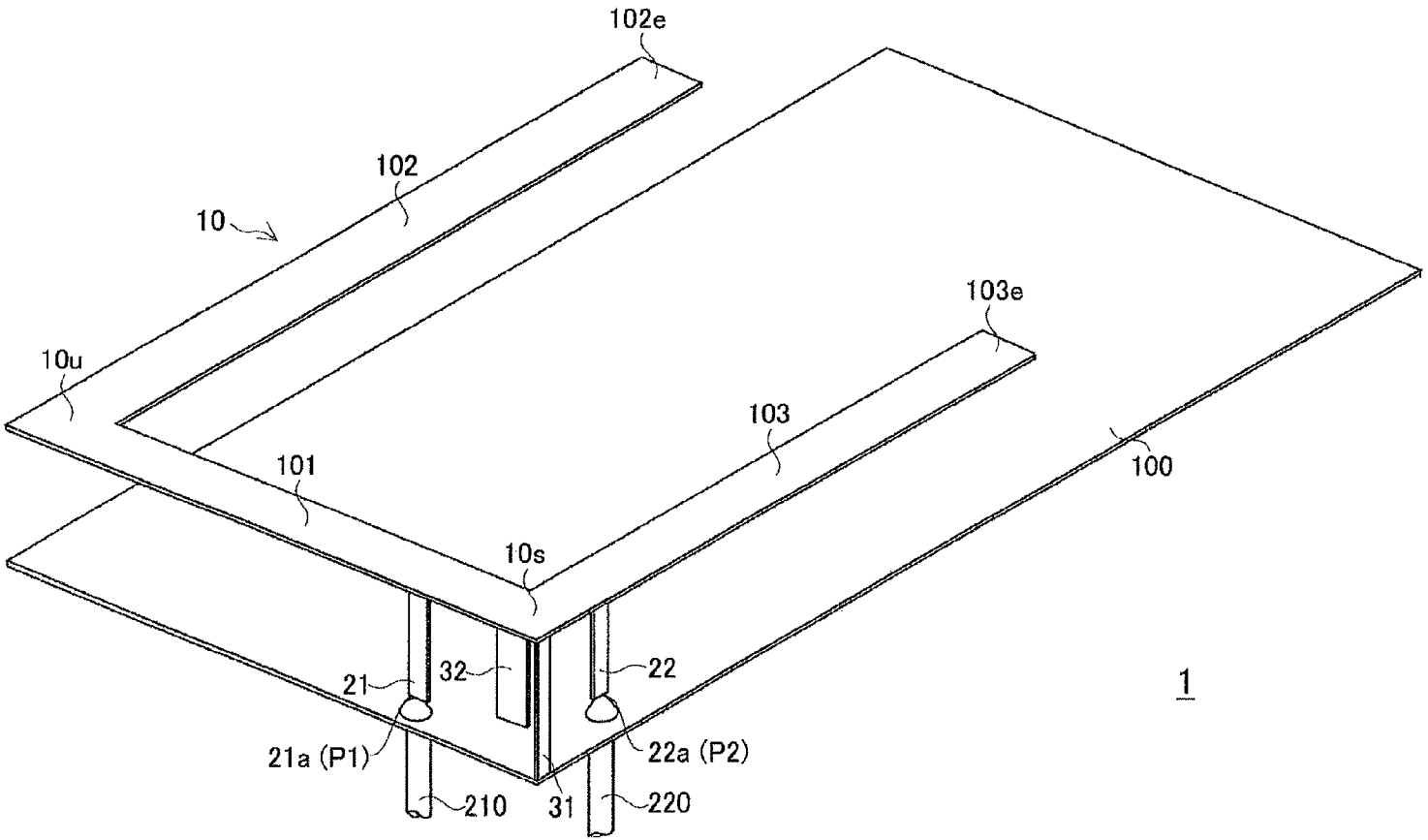
[FIG. 1]

In the accompanying text describing the first embodiment of a planar inverted-F antenna (PIFA) 1, refer to FIGS. 1 to 4 for illustrations. As illustrated in FIG. 1, the PIFA 1 includes a conductive radiating element 10 that is spaced from the ground plane 100 and extending substantially parallel thereto. The PIFA 1 also includes a first feed element 21 and a second feed element 22, both of which may be a conductive pin, post or strip vertically positioned between the radiating element 10 and the ground plane 100. The PIFA 1 further includes a first shorting element 31 and a second shorting element 32, both of which may be a conductive planar strip vertically positioned between the radiating element 10 and the ground plane 100. A dielectric substrate (not shown) may be disposed between the radiating element 10 and the ground plane 100.

The radiating element 10 is substantially a single U-shaped planar strip having a first part 101, a second part 102 and a third part 103. The first part 101 extends from a first corner 10*s* to a second corner 10*u* of the radiating element 10. The second part 102 extends from the second corner 10*u* to one free end 102*e* of the radiating element 10. The third part 103 extends from the first corner 10*s* to the other free end 103*e* of the radiating element 10. In the illustrated radiating element 10, the angle between the first part 101 and the second part 102 is 90 degrees, but is not limited to such, and the angle between the first part 101 and the third part 103 is 90 degrees, but is not limited to such. Those angles could be greater or less than 90 degrees as long as the radiating element 10 is substantially U-shaped. The first corner 10*s* and the second corner 10*u* may be formed by curved portions between the parts of the radiating element 10. In the PIFA1 according to the present embodiment, the first part 101 and the second part 102 of the radiating element 10 serve as a first radiator of a PIFA element operating at a low resonant frequency band, while the third part 103 of the radiating element 10 serves as a second radiator of a PIFA element operating at a high resonant frequency band. As the radiating element 10 is substantially U-shaped, the overall design of the PIFA 1 becomes small and compact, while the radiating element 10 serves as a dual-band radiator.

A RF cable 210 and the first feed element 21 serve as an electrical path for radio frequency (RF) power to the first part 101 of the radiating element 10. The RF cable 210, passing through a suitable hole (not shown) in the ground plane 100 in such a manner that the RF cable 210 is electrically isolated from the ground plane 100, is electrically connected to the first feed element 21 at one end 21*a* of the first feed element 21 with solder. The first feed element 21 is electrically connected to the first part 101 of the radiating element 10 at the other end (not visible in FIG. 1) of the first feed element 21 with solder. A feed port through which RF power is provided from the RF cable 210 is denoted as P1. The RF cable 210 may preferably be a coaxial cable.

A RF cable 220 and the second feed element 22 serve as an electrical path for radio frequency (RF) power to the third part 103 of the radiating element 10. The RF cable 220, passing through a suitable hole (not shown) in the ground plane 100 in such a manner that the RF cable 220 is electrically isolated from the ground plane 100, is electrically connected to the second feed element 22 at one end 22*a* of the second feed element 22 with solder. The second feed element 22 is electrically connected to the third part 103 of the radiating element 10 at the other end (not visible in FIG. 1) of the second feed element 22 with solder. A feed port through which RF power is provided from the RF cable 220 is denoted as P2. The RF cable 220 may preferably be a coaxial cable.

Figure 2:
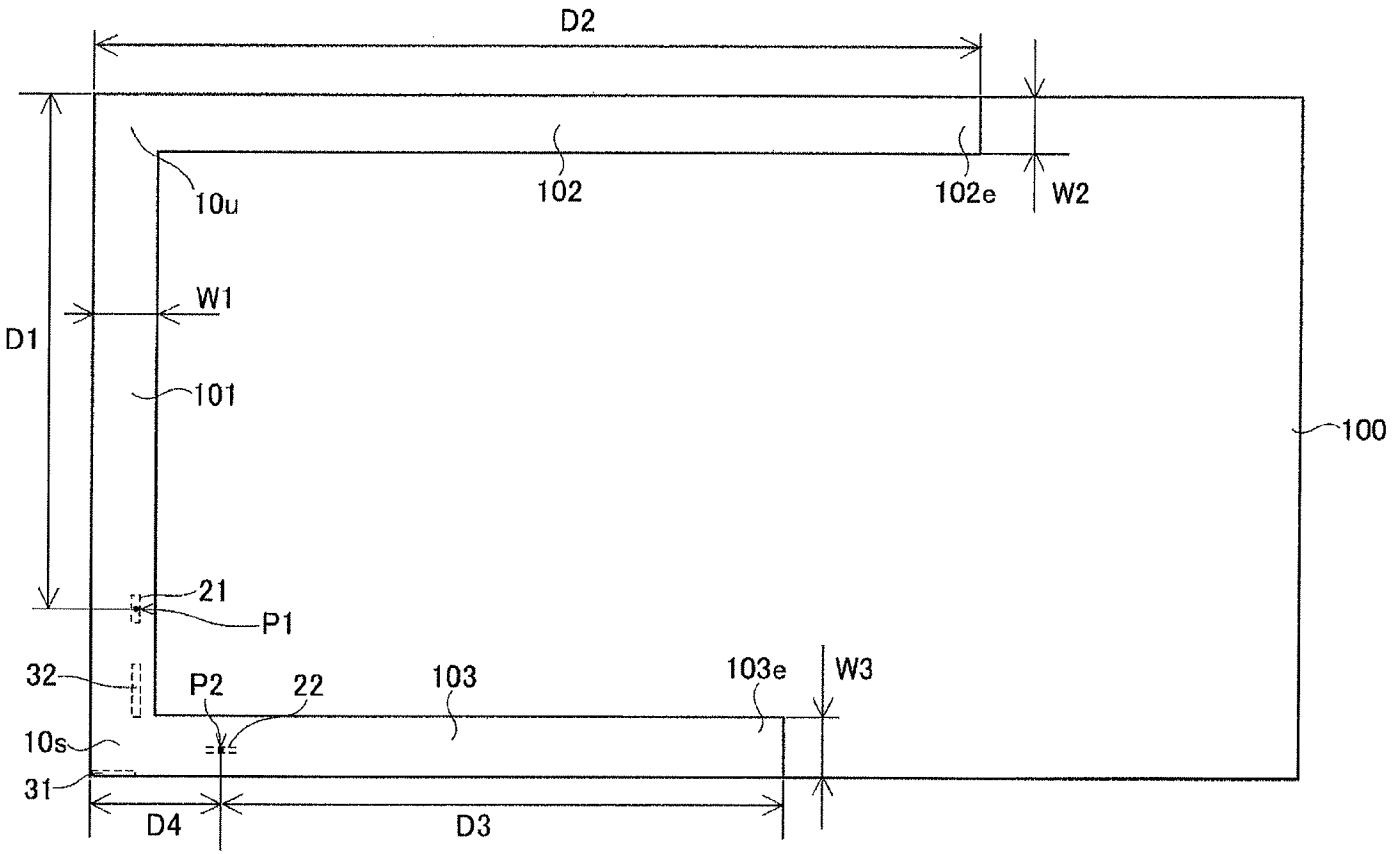
[FIG. 2]
Figure 3:
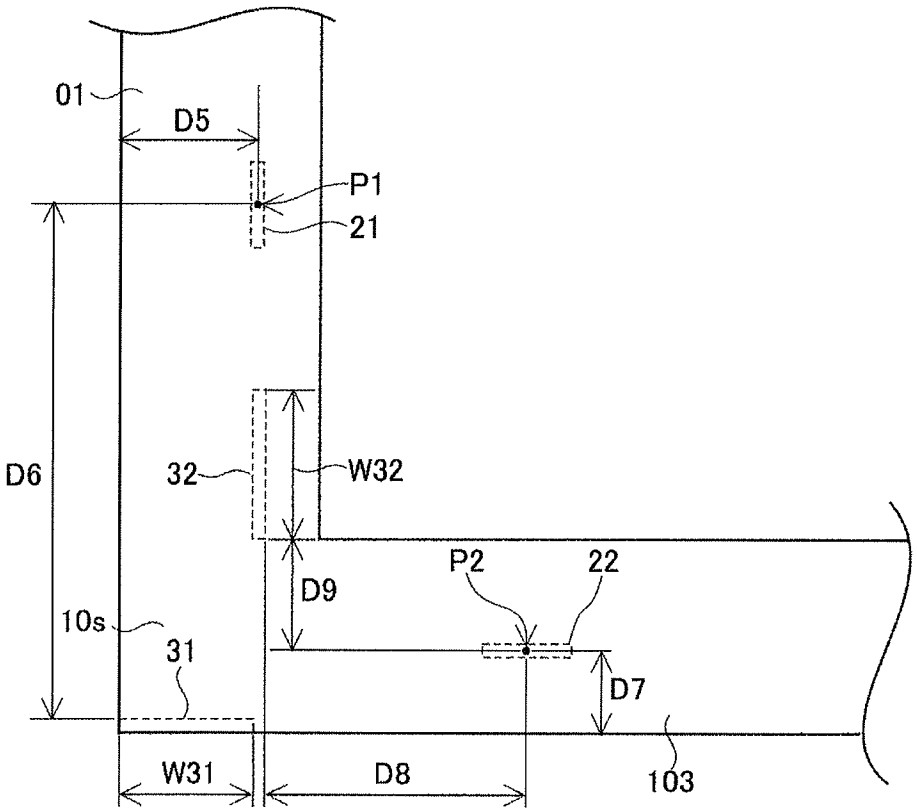
[FIG. 3]

The first shorting element 31 and the second shorting element 32 electrically connect the radiating element 10 to the ground plane 100. As illustrated in FIGS. 1 to 3, the first shorting element 31 and the second shorting element 32 reside beneath the first corner 10*s* of the radiating element 10 or adjacent area thereof. The first shorting element 31 may be a first strip, while the second shorting element 32 may be a second strip in the present embodiment.

In the PIFA 1 according to the present embodiment, the first part 101 and the second part 102 of the radiating element 10, the first feed element 21 and the first shorting element 31 serve as a PIFA element operating at a low resonant frequency band, while the third part 103 of the radiating element 10, the second feed element 22 and the second shorting element 32 serve as a PIFA element operating at a high resonant frequency band.

In FIG. 2, the sum of the distance D1 and D2 between the feed port P1 and the free end 102*e* of the radiating element 10 is a parameter that controls the low resonant frequency of the PIFA 1. In FIG. 2, the distance between the feed port P1 and the first shorting element 31 is a parameter that influences the low resonant frequency of the PIFA 1 and mutual coupling between the feed port P1 and the feed port P2. As illustrated in FIG. 3, the distance between the feed port P1 and the first shorting element 31 is determined by the width W31 of the first shorting element 31, the distance D5 between the feed port P1 and the outer edge of the first part 101 of the radiating element 10, and the distance D6 between the feed port P1 and the outer edge of the third part 103 of the radiating element 10.

In FIG. 2, the distance D3 between the feed port P2 and the free end 103*e* of the radiating element 10 is a parameter that controls the high resonant frequency of the PIFA 1. The distance between the feed port P2 and the second shorting element 32 is a parameter that influences the high resonant frequency of the PIFA 1 and mutual coupling between the feed port P1 and the feed port P2. As illustrated in FIG. 3, the distance between the feed port P2 and the second shorting element 32 is determined by the width W32 of the second shorting element 32, the distance D7 between the feed port P2 and the outer edge of the third part 103 of the radiating element 10, the distance D8 between the feed port P2 and the second shorting element 32 measured in the direction along the outer edge of the third part 103 of the radiating element 10, and the distance D9 between the feed port P2 and an edge of the second shorting element 32 measured in the direction along the outer edge of the first part 101 of the radiating element 10.

Figure 4:
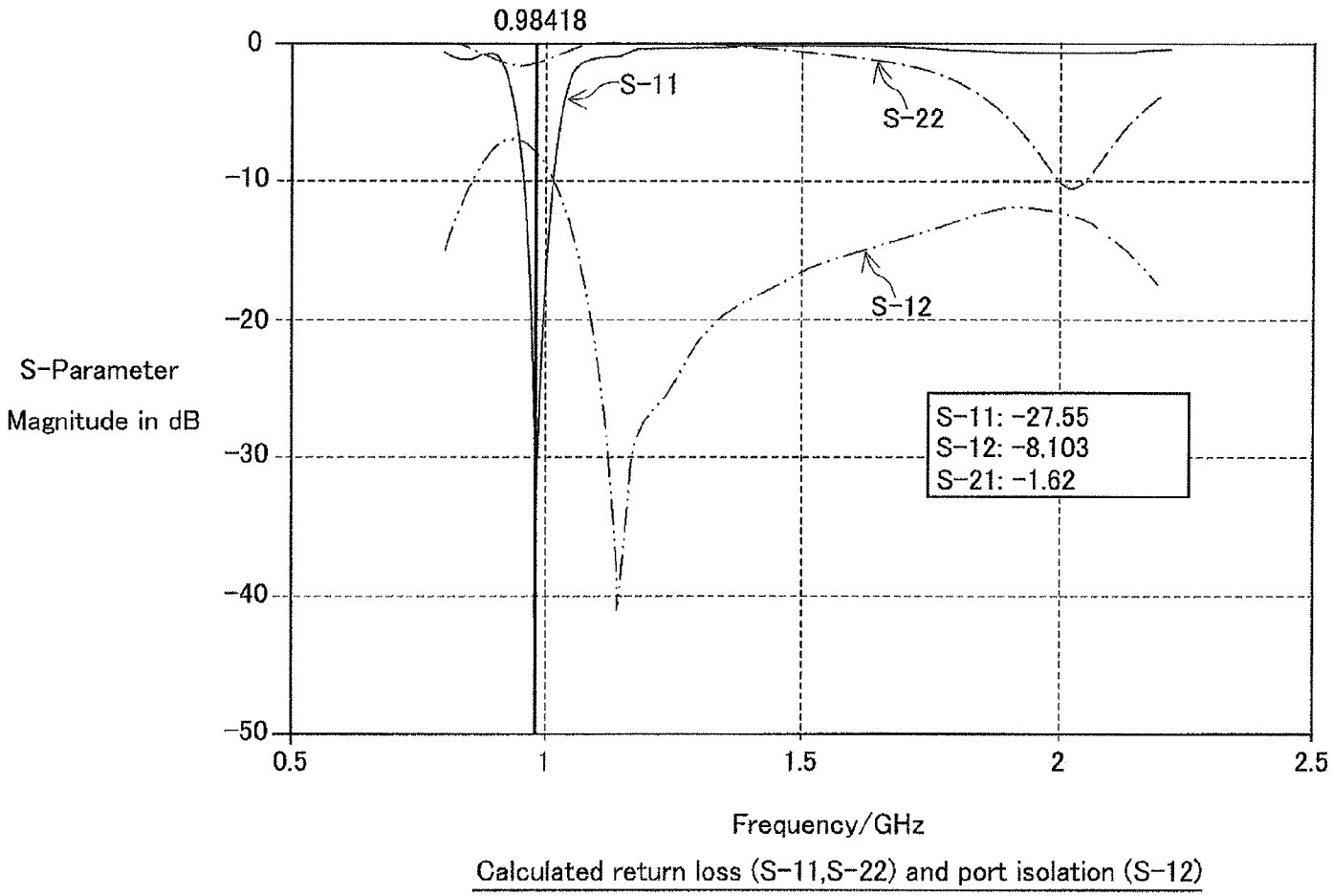
[FIG. 4]

FIG. 4 illustrates an example of calculated S-parameters of the PIFA 1 according to the present embodiment. In FIG. 4, S-11, S-22 and S-12 are frequency characteristics of return loss for the feed port P1, return loss for the feed port P2, and insertion loss from the feed port P1 to the feed port P2, respectively. Here, S-21, which is defined as insertion loss from the feed port P2 to the feed port P1, is omitted in FIG. 4 since S-21 is considered generally identical to S-12.

In the PIFA 1 according to the present embodiment, the feed port P1 and the feed port P2 are positioned on the either side of the first corner 10*s* of the radiating element 10, and the direction of the first part 101 of the radiating element 10 from the feed port P1 to the second corner 10*u* is different from that of the third part 103 of the radiating element 10 from the feed port P2 to the free end 103*e*. Thus, as illustrated in FIG. 4, the first radiator (the first part 101 and the second part 102 of the radiating element 10) and the second radiator (the third part 103 of the radiating element 10) function at the low and high resonant frequency bands respectively.

Further, as illustrated in FIG. 4, due to the arrangement of the first feed element 21 (or the feed port P1), the second feed element 22 (or the feed port P2), and the shorting elements 31, 32 around the first corner 10*s* of the radiating element 10 in the PIFA 1, a good mutual coupling performance (S-12) is achieved although the radiating element 10 is of a continuous surface. The reason of this is explained as follows. Namely, around the first corner 10*s* or the adjacent area thereof according to the arrangement of the PIFA 1, the first feed element 21 (or the feed port P1) is positioned close to the second shorting element 32, and the second feed element 22 (or the feed port P2) is positioned close to the first shorting element 31. Therefore, when the feed port P1, which is intended to operate at the low resonant frequency band, is excited at the high resonant frequency band, current flows from the feed port P1, through the first feed element 21, the first part 101 of the radiating element 10, the second shorting element 32, and to the ground plane 100. In a similar manner, when the feed port P2, which is intended to operate at the high resonant frequency band, is excited at the low resonant frequency band, current flows from the feed port P2, through the second feed element 22, the third part 103 of the radiating element 10, the first shorting element 31, and to the ground plane 100.

In view of the above, it is understood that the PIFA 1 according to the present embodiment, due to the arrangement of the radiation element 10 and the other elements in the PIFA 1, has therefore small and compact design while achieving good mutual coupling performance (good isolation).

(2) Second Embodiment

In the accompanying text describing the second embodiment of a planar inverted-F antenna (PIFA) 2, refer to FIGS. 5 to 8 for illustrations. The PIFA 2 according to the present embodiment is different from the PIFA 1 according to the first embodiment in that the PIFA 2 has a different second shorting element 132 from the second shorting element 32. Although, in FIGS. 5, 6 and 7, the elements other than the second shorting element 132 are given the identical reference numerals to those in the PIFA 1, the size of each element, the distance between elements, or the distance between the ports and the elements may be modified or optimized. Moreover, the descriptions of the elements other than the second shorting element 132 may be omitted for the sake of brevity.

Figure 7:
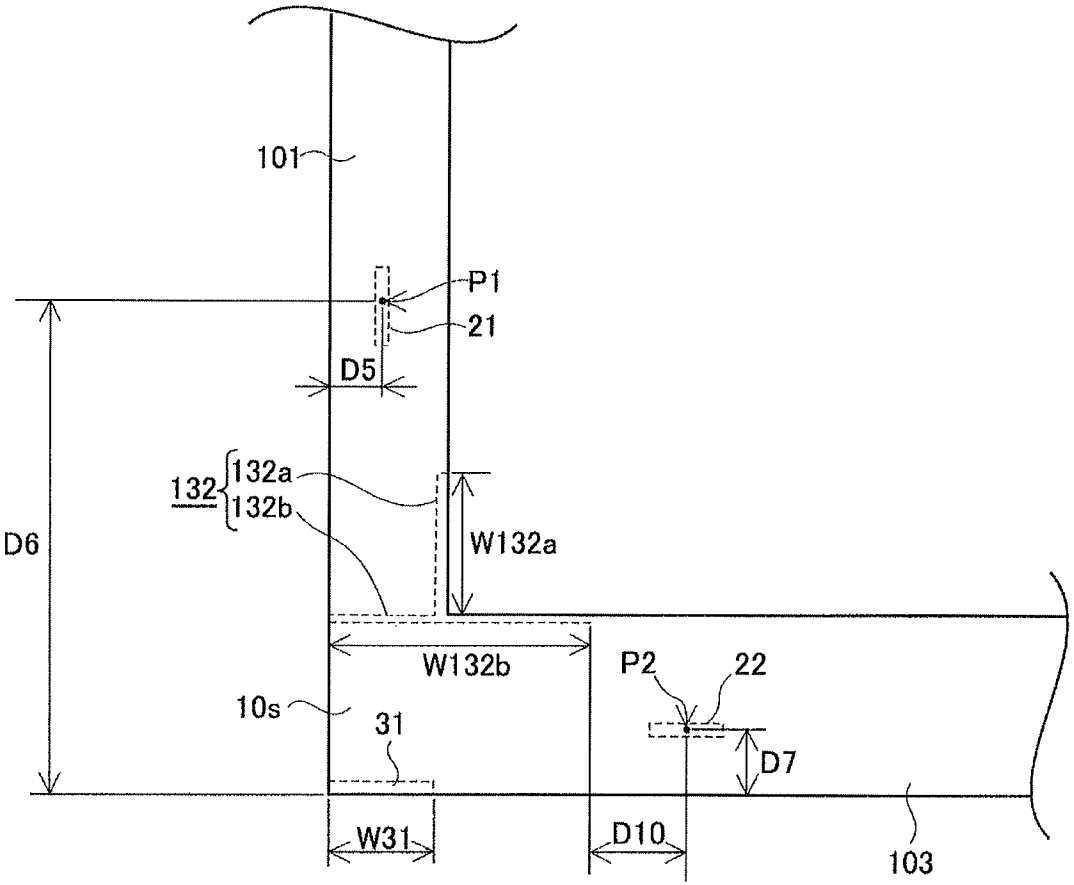
[FIG. 7]

As illustrated in FIG. 7, the second shorting element 132 in the PIFA 2 includes a conductive strip 132*a* (second strip) and a conductive strip 132*b* (third strip). The strip 132*a* resides beneath the radiating element 10 substantially at the first part 101 adjacent to the first corner 10*s* of the radiating element 10, and is arranged to be parallel to the first part 101 of the radiating element 10. Although, in FIG. 7, the strip 132*a* is positioned along the inner edge of the first part 101 of the radiating element 10, the strip 132*a* may be spaced apart from the edge of the first part 101 of the radiating element 10. The strip 132*b* resides beneath the radiating element 100, and is attached to and positioned perpendicular to the strip 132*a*. The strip 132*b* is also arranged to be parallel to the third part 103 of the radiating element 10. Although, in FIG. 7, the strip 132*b* is positioned along the inner edge of the third part 103 of the radiating element 10, the strip 132*b* may be spaced apart from the edge of the third part 103 of the radiating element 10.

The distance between the feed port P2 and the second shorting element 132 is a parameter that influences the high resonant frequency of the PIFA 2 and mutual coupling between the feed port P1 and the feed port P2. As illustrated in FIG. 7, the distance between the feed port P2 and the second shorting element 132 is determined by the width W132*b* of the strip 132*b*, the distance D7 between the feed port P2 and the outer edge of the third part 103 of the radiating element 10, and the distance D10 between the feed port P2 and the edge of the strip 132*b* measured in the direction along the outer edge of the third part 103 of the radiating element 10.

Figure 8:
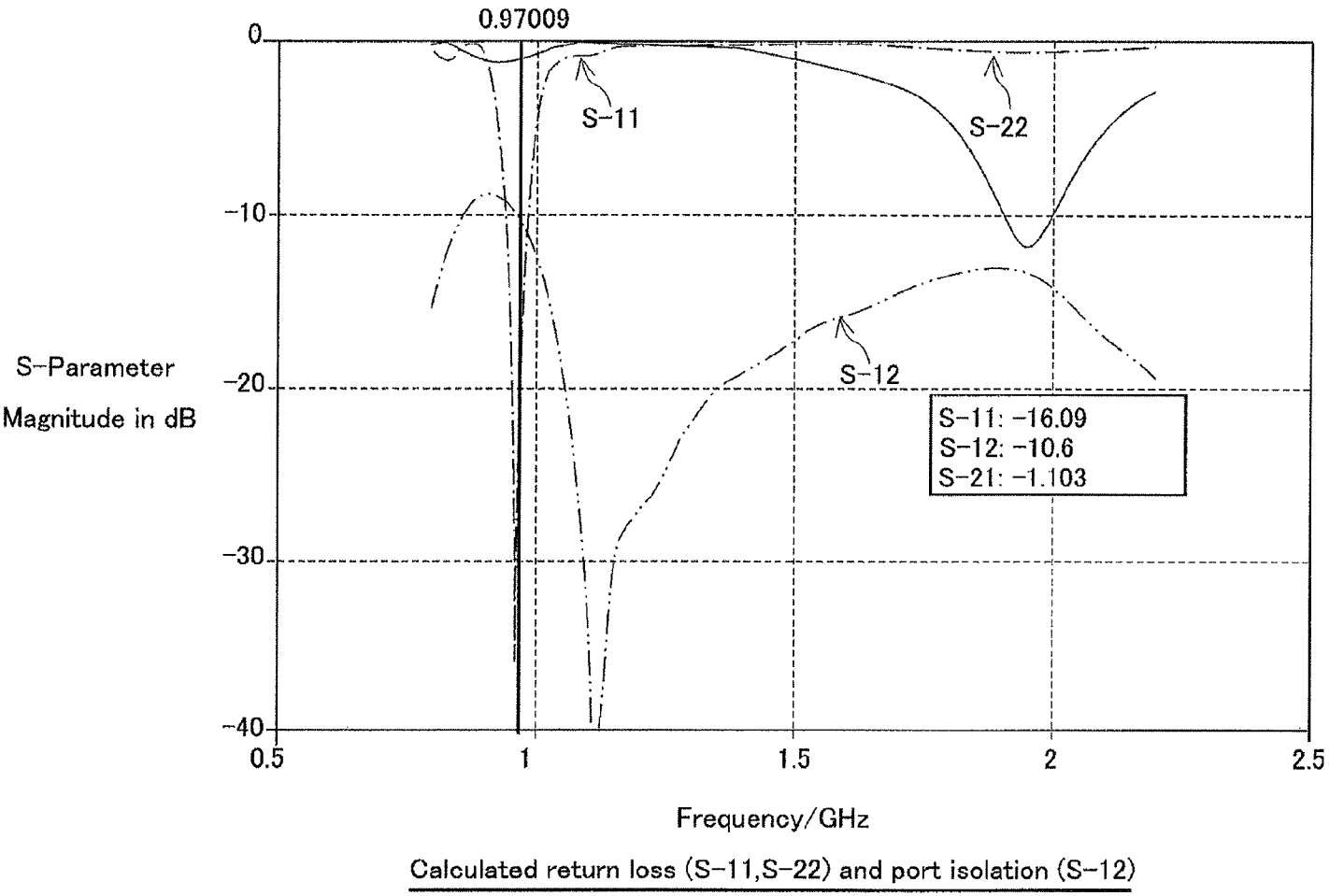
[FIG. 8]

FIG. 8 illustrates an example of calculated S-parameters of the PIFA 2 according to the present embodiment. In FIG. 8, S-11, S-22 and S-12 are frequency characteristics of return loss for the feed port P1, return loss for the feed port P2, and insertion loss from the feed port P1 to the feed port P2, respectively. Here, S-21, which is defined as insertion loss from the feed port P2 to the feed port P1, is omitted in FIG. 8 since S-21 is considered generally identical to S-12.

When comparing S-12 of FIGS. 4 and 8, it is understood that the PIFA 2 according to the present embodiment exhibits even better mutual coupling performance, by 2 to 3 dB, than that of the PIFA 1 according to the first embodiment. Due to the additional conductive strip 132*b* of the PIFA 2, the second shorting element 132 is able to conduct current to the ground plane 100 more effectively. More specifically, when the feed port P1, which is intended to operate at the low resonant frequency band, is excited at the high resonant frequency band, current flows from the feed port P1, through the first feed element 21, the first part 101 of the radiating element 10, the second shorting element 132, and to the ground plane 100 effectively due to the larger area of the second shorting element 132.

(3) Third Embodiment

In the accompanying text describing the second embodiment of a planar inverted-F antenna (PIFA) 3, refer to FIGS. 9 to 12 for illustrations. PIFA 3 according to the present embodiment has modified shorting elements, namely a first shorting element 231 and a second shorting element 232. Although, in FIGS. 9, 10 and 11, the elements other than the shorting elements 231, 232 are given the identical reference numerals to those in the PIFA 1, the size of each element, the distance between elements, or the distance between the ports and the elements may be modified or optimized. Moreover, the descriptions of the elements other than the shorting elements 231, 232 may be omitted for the sake of brevity.

Figure 9:
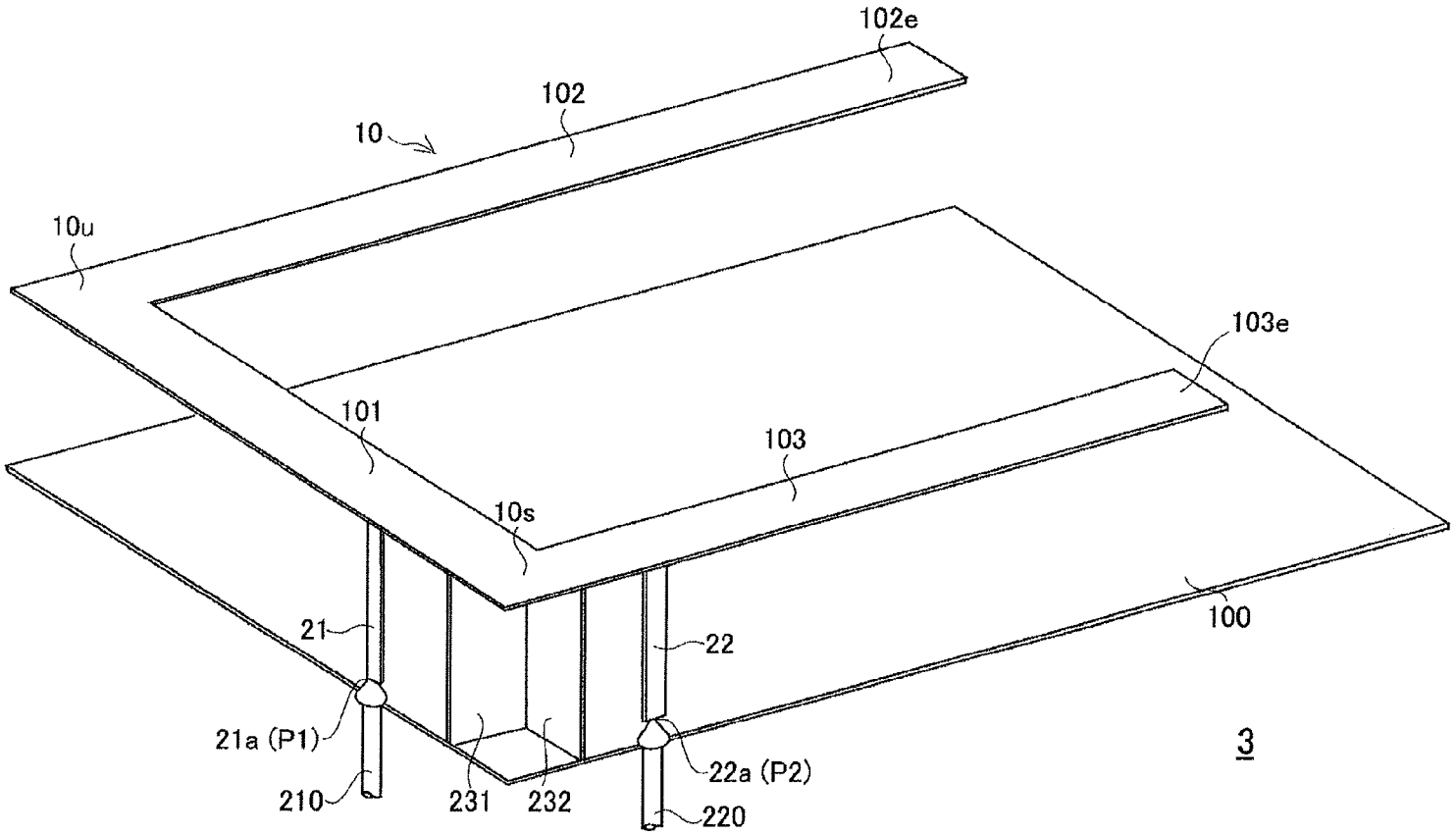
[FIG. 9]
Figure 10:
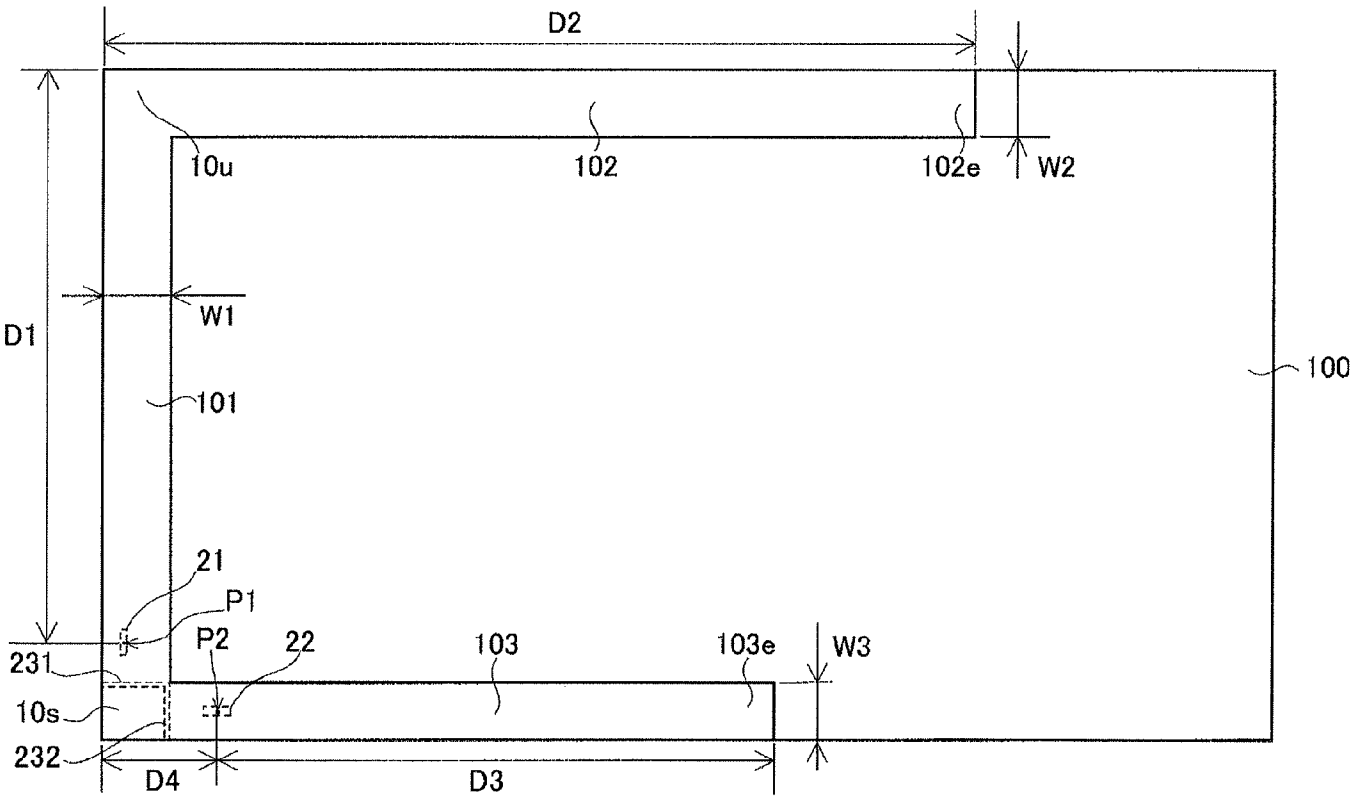
[FIG. 10]
Figure 11:
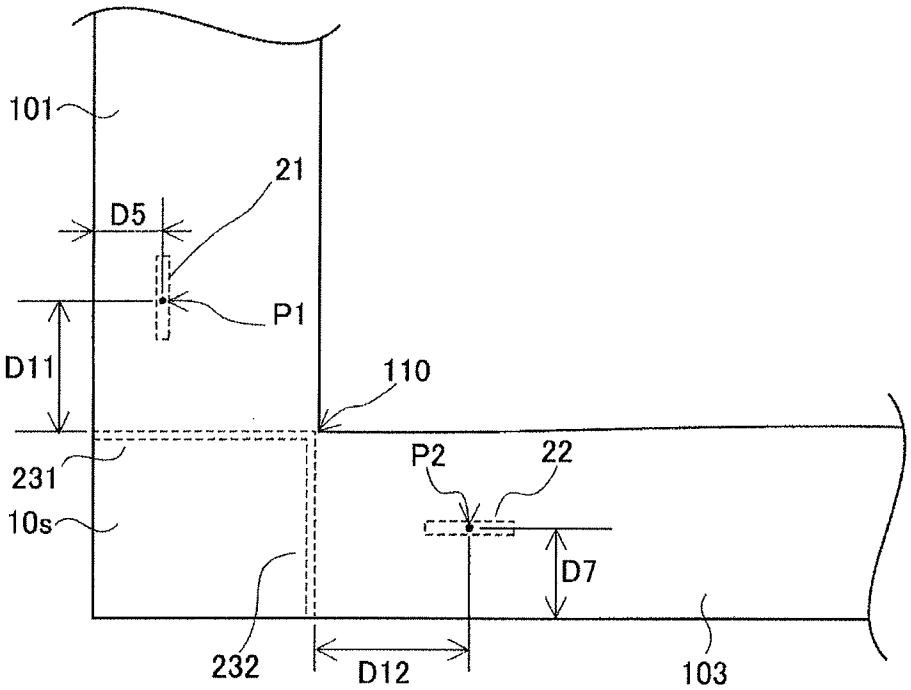
[FIG. 11]

Preferably, as illustrated in FIGS. 9 to 11, the first shorting element 231 and the second shorting element 232 are combined to form a substantially L-shaped element. As illustrated in FIGS. 9 to 11, the first shorting element 231 may include a conductive strip (fourth strip) that extends from an inner edge 110 (see FIG. 11), at which the first part 101 and the third part 103 of the radiating element 10 intersect, over the width of the first part 101 of the radiating element 10, while the second shorting element 232 may include a conductive strip (fifth strip) that extends from the inner edge 110 over the width of the third part 103 of the radiating element 10. The first shorting element 231 and the second shorting element 232 reside beneath and vertically to the radiating element 10. Although, in the illustrated example of FIG. 11, the angle between the first shorting element 231 and the second shorting element 232 is 90 degrees, that angle is not limited to 90 degrees. Although, in the illustrated example of FIG. 11, shorting elements 231 and 232 are positioned parallel to the third part 103 and the first part 101 of the radiating element 10 respectively, the shorting elements 231 and 232 may be arranged not to be parallel to the third part 103 and the first part 101.

Referring to FIG. 11, the distance D11 between the feed port P1 and the first shorting element 231 is a parameter that influences the low resonant frequency of the PIFA 3 and mutual coupling between the feed port P1 and the feed port P2. The distance D12 between the feed port P2 and the second shorting element 232 is a parameter that influences the high resonant frequency of the PIFA 3 and mutual coupling between the feed port P1 and the feed port P2.

Figure 12:
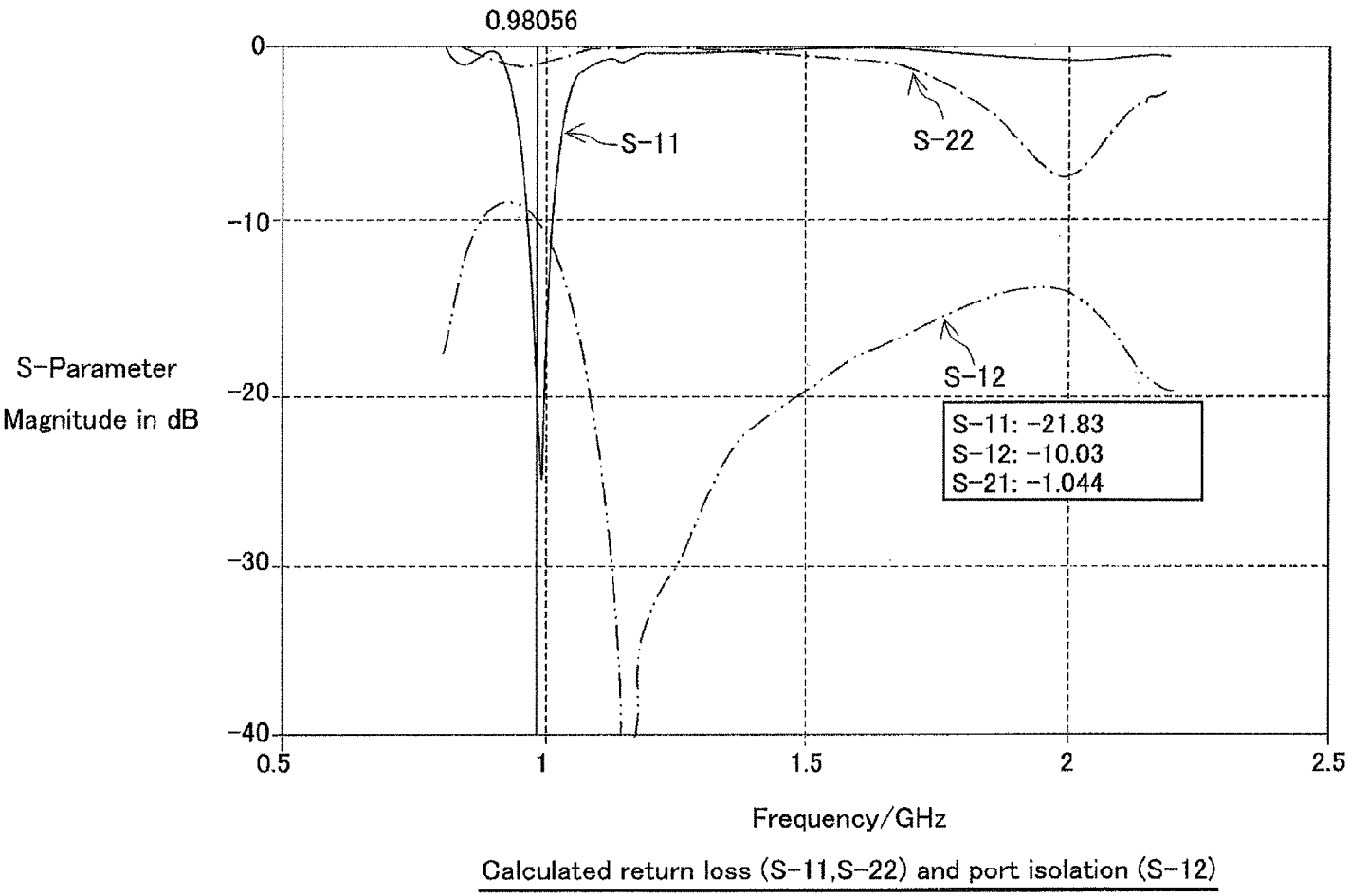
[FIG. 12]

FIG. 12 illustrates an example of calculated S-parameters of the PIFA 3 according to the present embodiment. In FIG. 12, S-11, S-22 and S-12 are frequency characteristics of return loss for the feed port P1, return loss for the feed port P2, and insertion loss from the feed port P1 to the feed port P2, respectively. Here, S-21, which is defined as insertion loss from the feed port P2 to the feed port P1, is omitted in FIG. 12 since S-21 is considered generally identical to S-12.

When comparing S-12 of FIGS. 8 and 12, it is recognized that the PIFA 3 according to the present embodiment exhibits a mutual coupling performance that is almost as good as that of the PIFA 2, despite that the PIFA 3 has the second shorting element 232 of a single strip in contrast with the PIFA 2 having the second shorting element 132 comprised of two strips 132*a*, 132*b*. This is because the L-shaped strip comprised of the shorting elements 231 and 232 is able to conduct current to the ground plane 100 as effectively as the second shorting element 132 of the PIFA 2. The shorting elements 231 and 232 provide a shorting function for PIFA elements operating at a low resonant frequency band and a high resonant frequency band respectively while achieving effective current flow for separation between the feed ports P1, P2. More specifically, when the feed port P1, which is intended to operate at the low resonant frequency band, is excited at the high resonant frequency band, current flows from the feed port P1, through the first feed element 21, the first part 101 of the radiating element 10, the L-shaped strip, and to the ground plane 100 effectively. In a similar manner, when the feed port P2, which is intended to operate at the high resonant frequency band, is excited at the low resonant frequency band, current flows from the feed port P2, through the second feed element 22, the third part 103 of the radiating element 10, the L-shaped strip, and to the ground plane 100 effectively. This effective current flow is resulted from the larger area of the L-shaped strip.

In view of the above, it is understood that PIFA 3 according to the present embodiment has modified shorting elements, thereby enabling good mutual coupling performance (good isolation) while being cost-effective and easy to fabricate, namely ideal for mass production.

Figure 13:
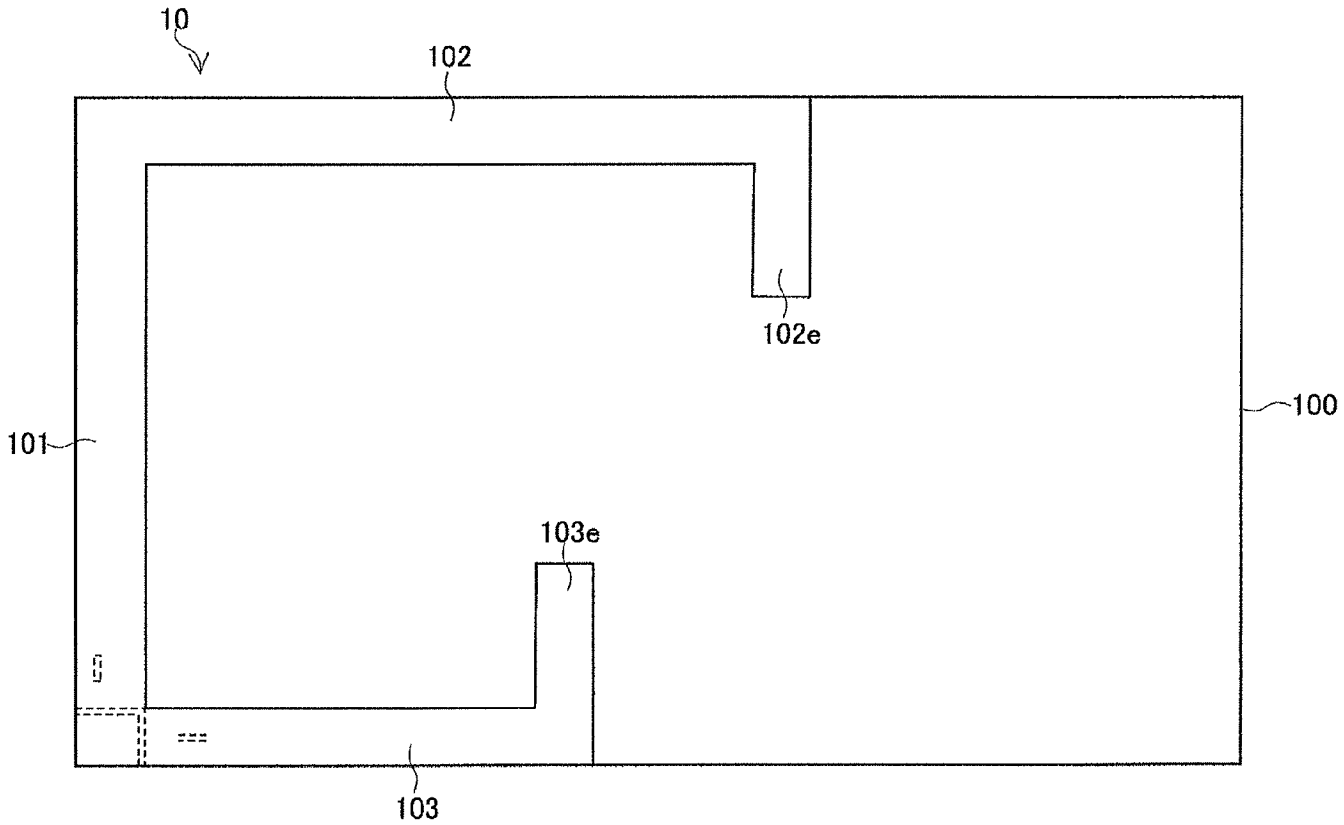
[FIG. 13]

In the illustrated PIFAs of the foregoing embodiments, the second part 102 and the third part 103 of the radiating element 10 are arranged to be straight. However, the second part 102 and/or the third part 103 of the radiating element 10 may be bent such that one of the free ends 102*e*, 103*e*, or both, faces inward as illustrated in FIG. 13 as an example. This modification allows the radiating element 10 to be even more compact. When the second part 102 and the third part 103 of the radiating element 10 are bent, it is preferable to prevent the free ends 102*e*, 103*e* from being close to each other and/or facing each other, which may cause undesirable influence on the mutual coupling.

In the illustrated PIFAs of the foregoing embodiments, it is preferable that the radiating element 10 is placed on a stiff substrate, thereby stabilizing the radiating element 10. This allows a constant height of the radiating element 10 from the ground plane 100 throughout the entire radiating element 10, and therefore allows stable radiation characteristics.

(4) Exemplary PIFA

The exemplary PIFA, which is described below, is based on the PIFA 2 according to the second embodiment, and the dimensions are: D1=27 mm; D2=46 mm; D3=28 mm; D4=7 mm; D5=1 mm; D6=9 mm; D7=1 mm; D10=2 mm; W1=2 mm; W2=2 mm; W3=3 mm; W31=2 mm; W132*a*=3 mm; and W132*b*=5 mm (refer to FIGS. 5, 6 and 7). Note that H1=9 mm, where H1 is denoted as the height of the radiating element 10 from the ground plane 100.

Figure 14:
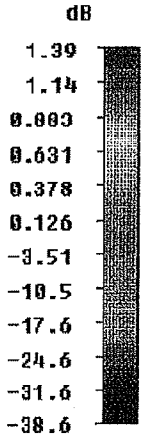
[FIG. 14]
Figure 14:
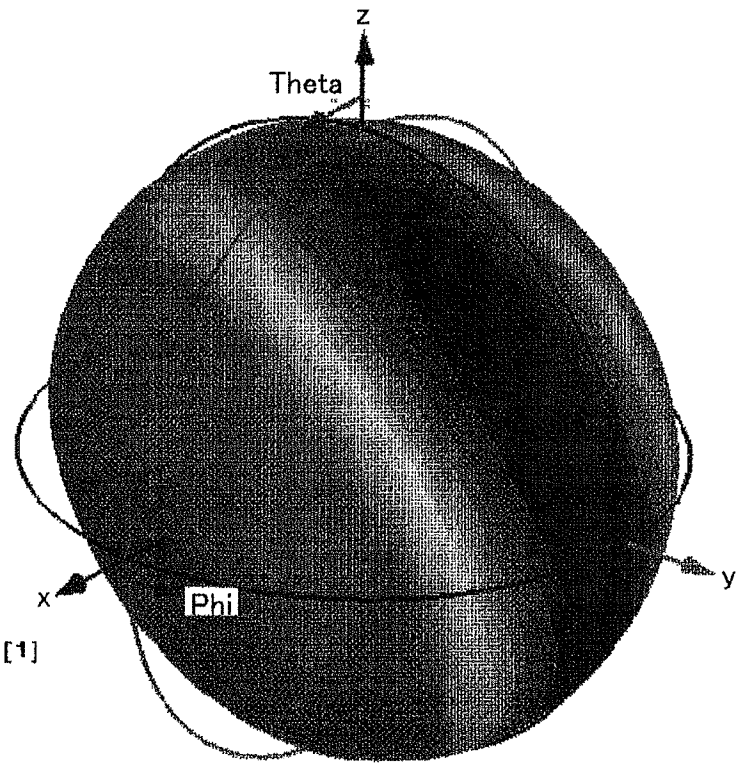
Figure 15:
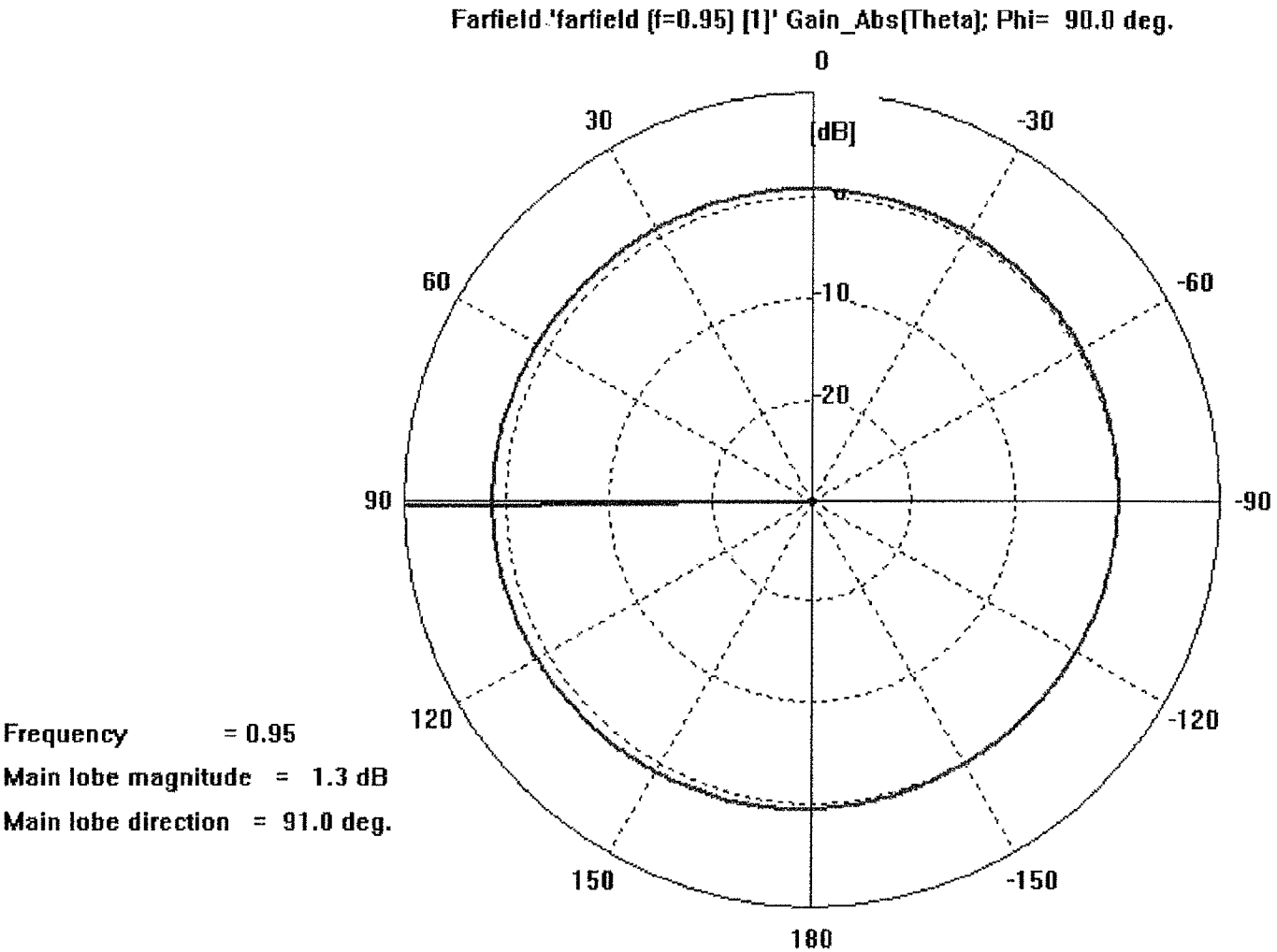
[FIG. 15]
Figure 16:
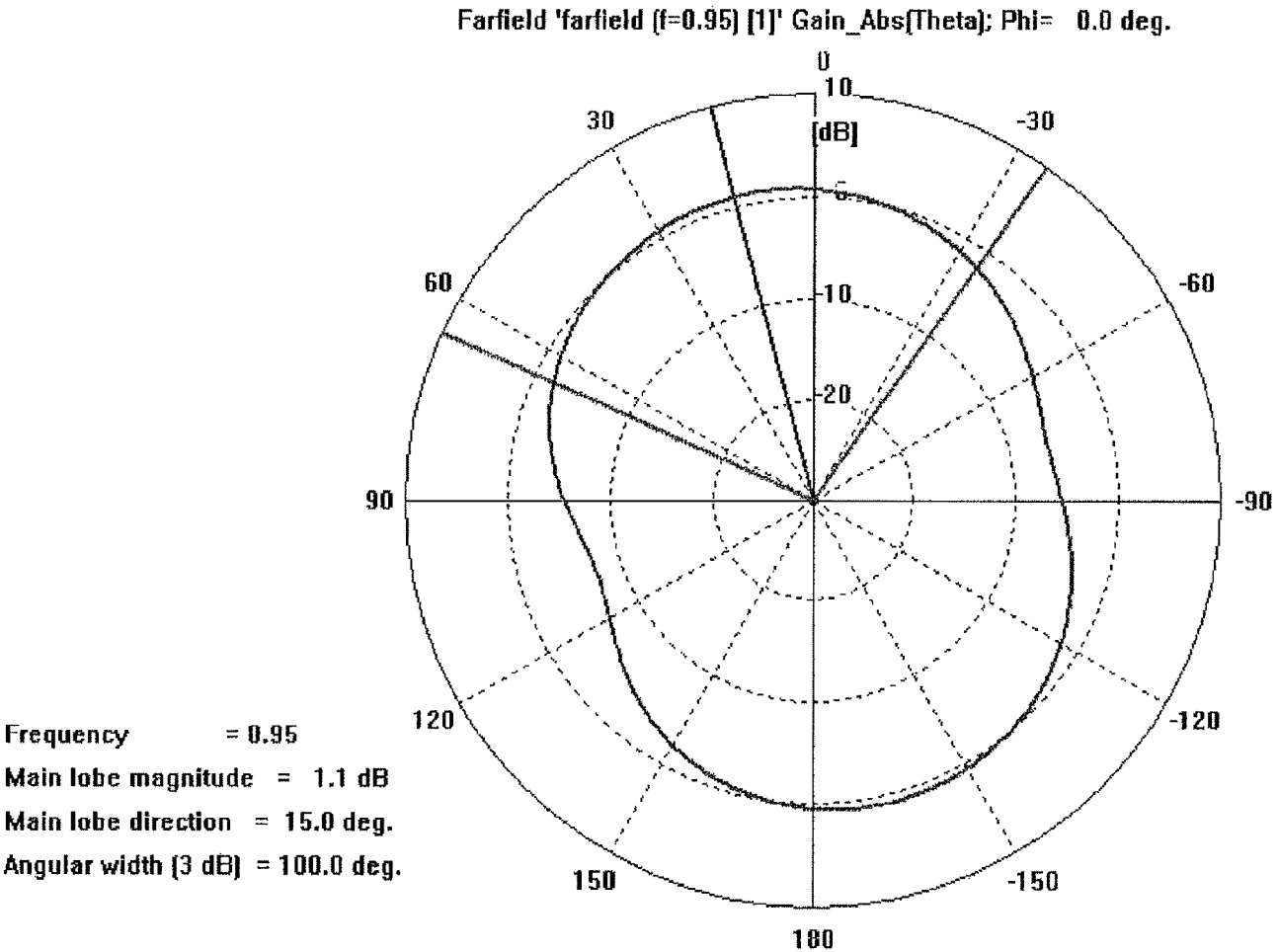
[FIG. 16]
Figure 17:
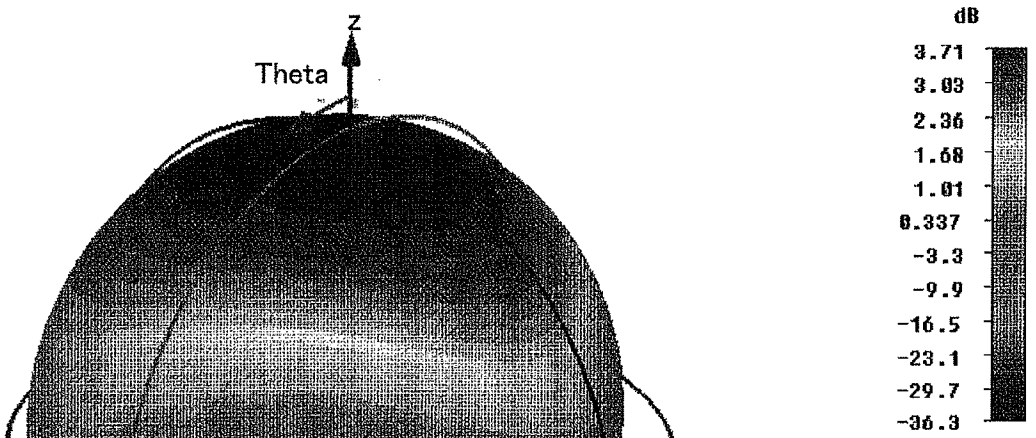
[FIG. 17]
Figure 18:
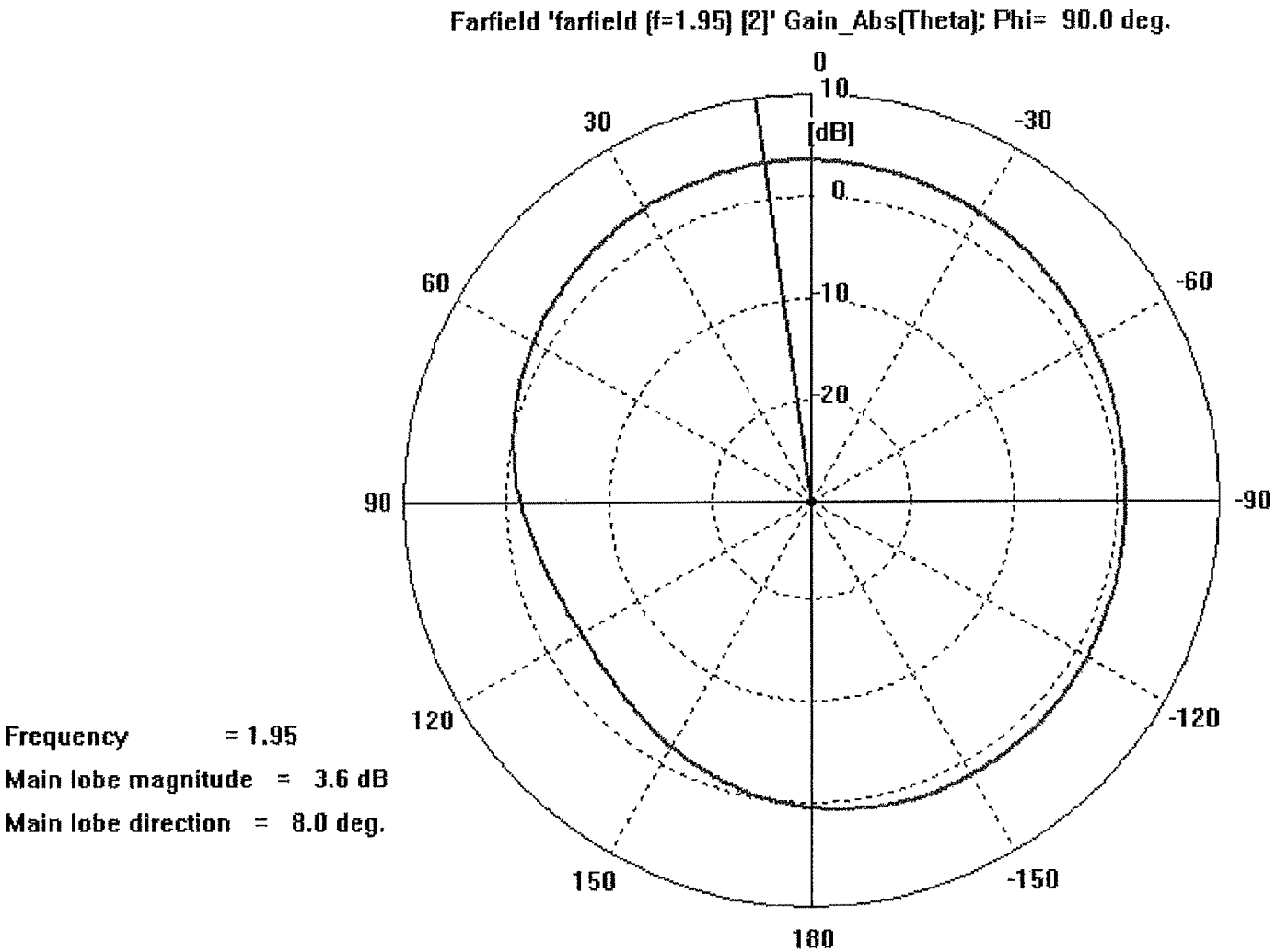
[FIG. 18]
Figure 19:
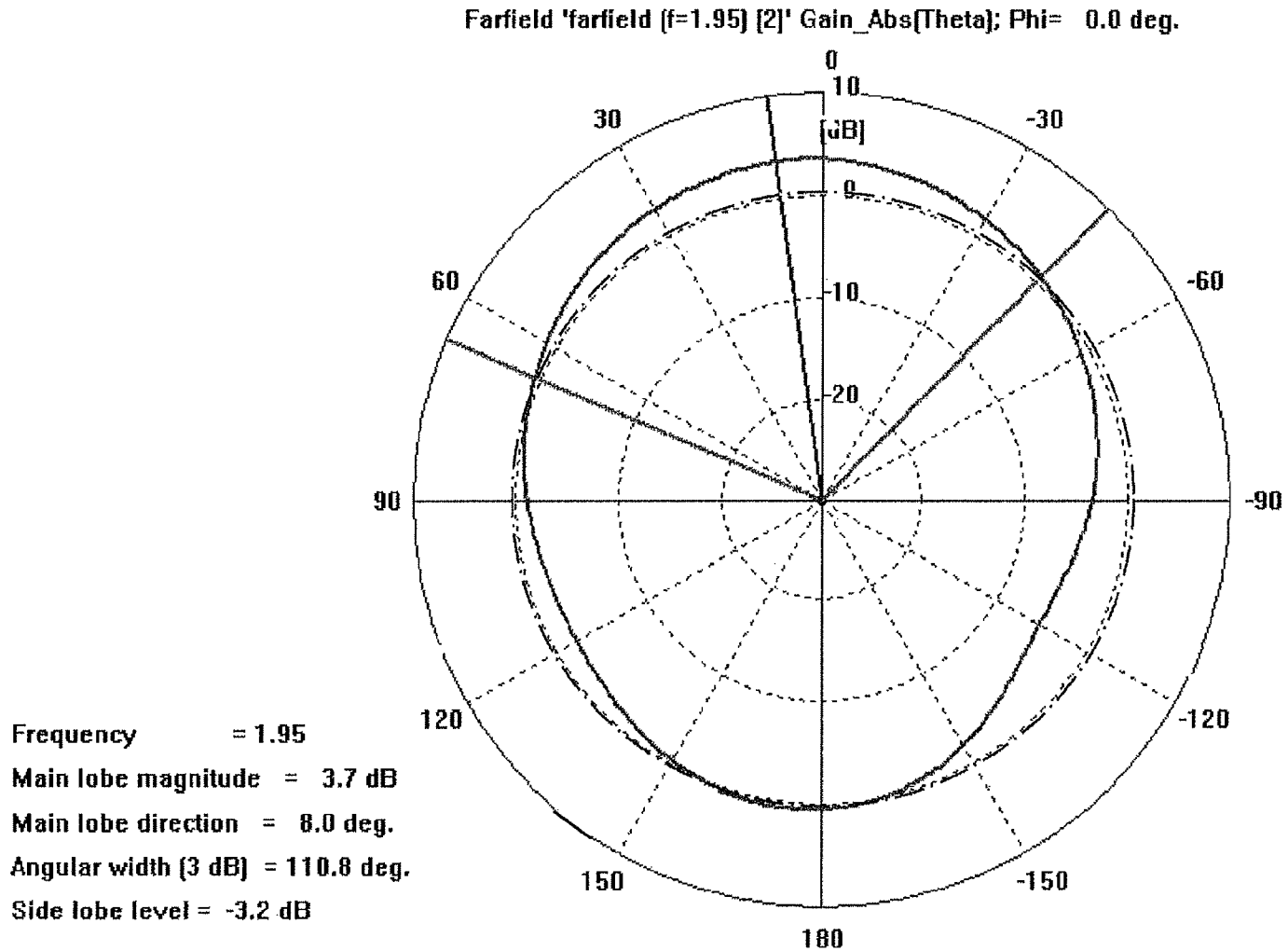
[FIG. 19]

FIGS. 14 to 19 illustrate simulation results of far-field gain patterns of the exemplary PIFA. FIG. 14 illustrates a far-field 3D gain pattern under the feed port P1 excitation at 950 MHz. FIGS. 15 and 16 illustrate gain patterns at specified planes under the feed port P1 excitation at 950 MHz; FIG. 15 corresponds to a far-field gain for angle Theta in a vertical plane at an angle Phi=90 degrees, i.e. the yz-plane at x=0; FIG. 16 corresponds to a far-field gain for angle Theta in a vertical plane at an angle Phi=0 degree, i.e. the xz-plane at y=0. FIG. 17 illustrates a far-field 3D gain pattern under the feed port P2 excitation at 1.95 GHz. FIGS. 18 and 19 illustrate gain patterns at specified planes under the feed port P2 excitation at 1.95 GHz; FIG. 18 corresponds to a far-field gain for angle Theta in a vertical plane at an angle Phi=90 degrees, i.e. the yz-plane at x=0; FIG. 19 corresponds to a far-field gain for angle Theta in a vertical plane at an angle Phi=0 degree, i.e. the xz-plane at y=0. Note that: x, y, z-axes in FIGS. 14 and 17 correspond to those indicated in FIG. 5; and angle Theta is measured from the vertical z-axis. As illustrated in FIGS. 14 to 19, it is understood that a good level of gain has been obtained in almost all directions with the exemplary PIFA.

Figure 20:
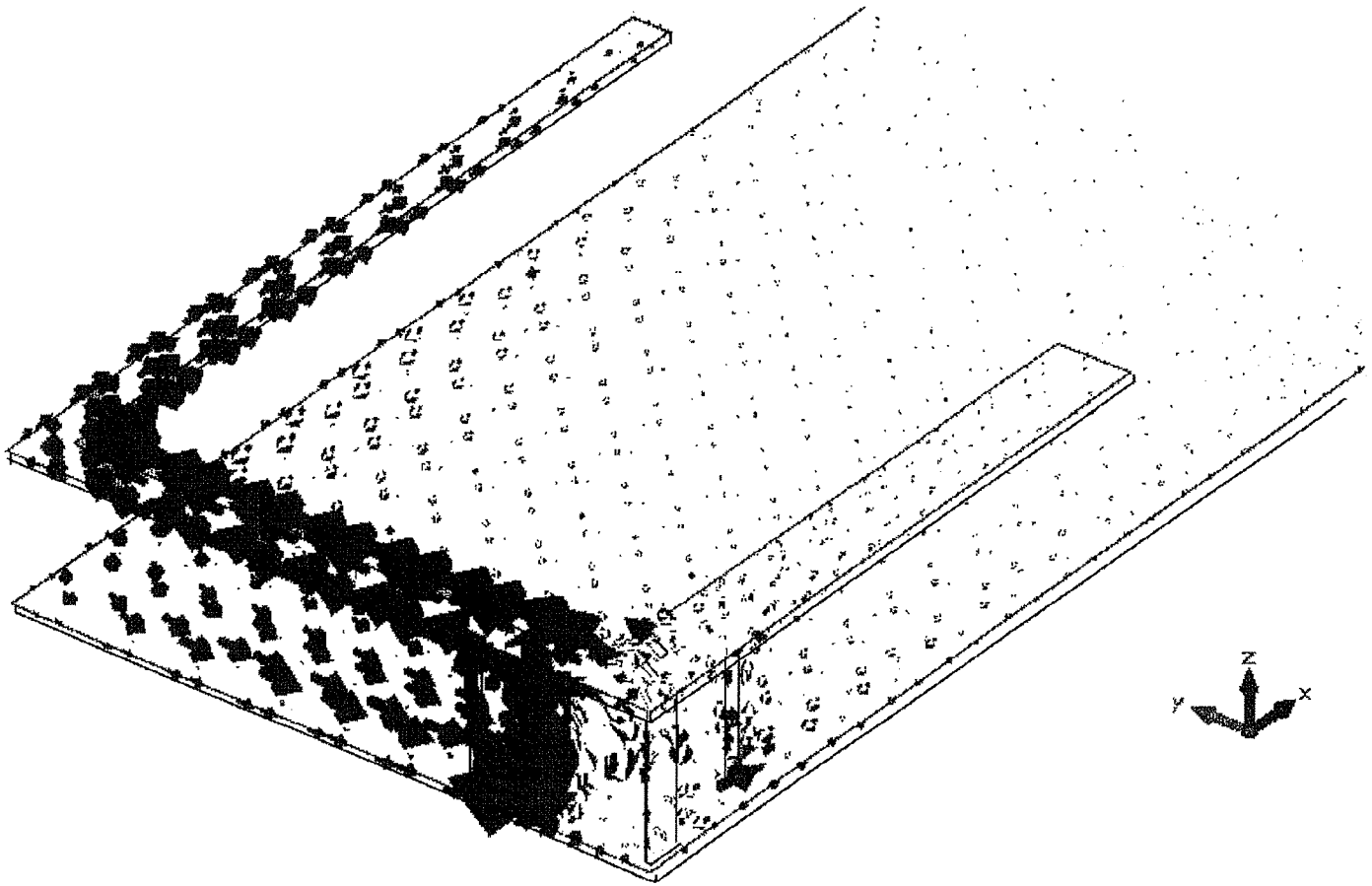
[FIG. 20]
Figure 21:
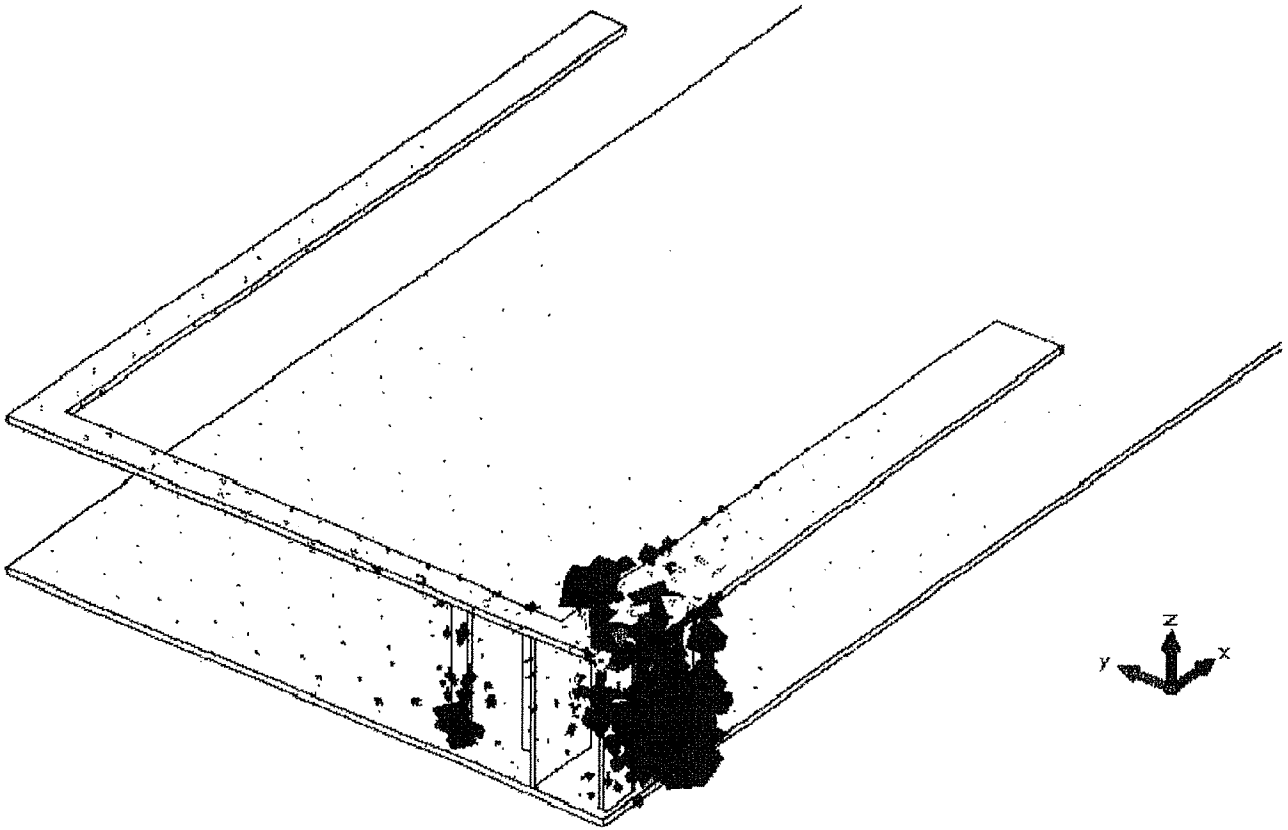
[FIG. 21]
Figure 22:
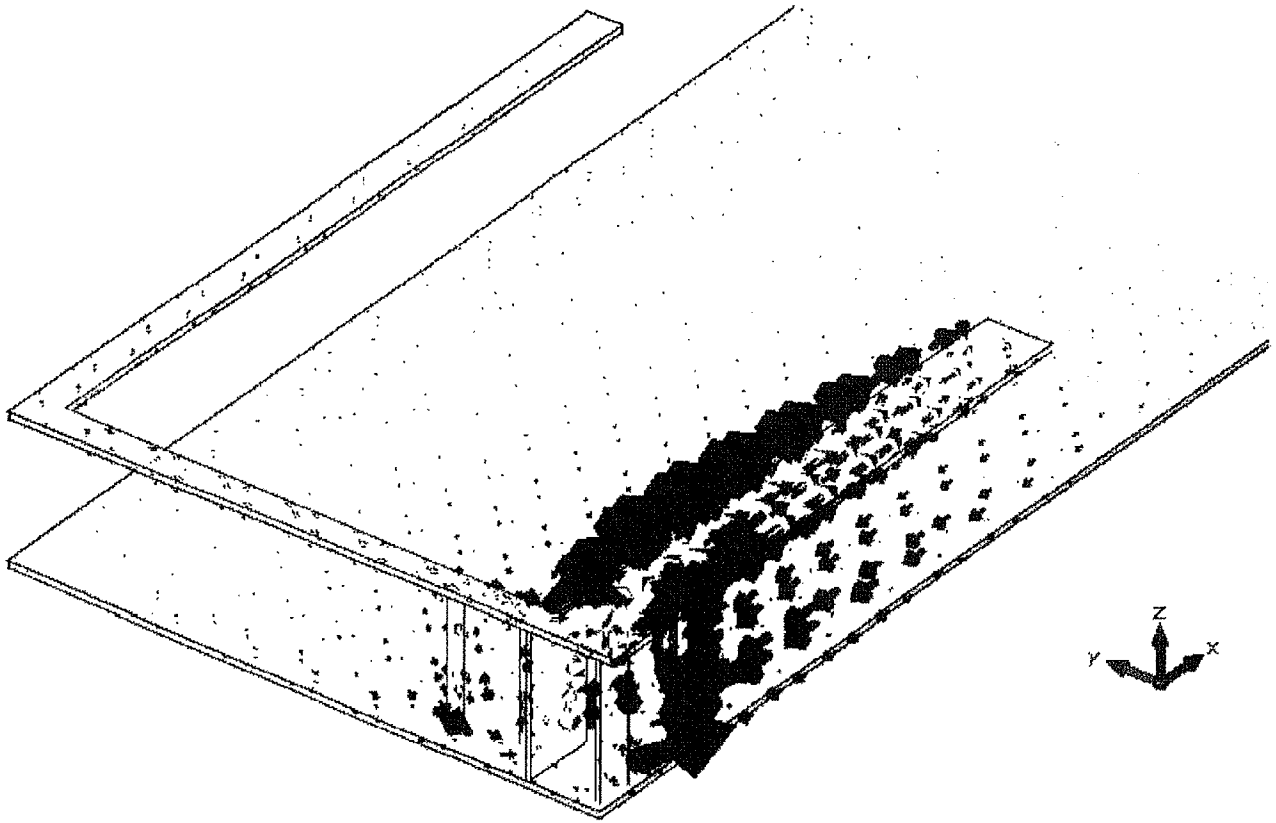
[FIG. 22]
Figure 23:
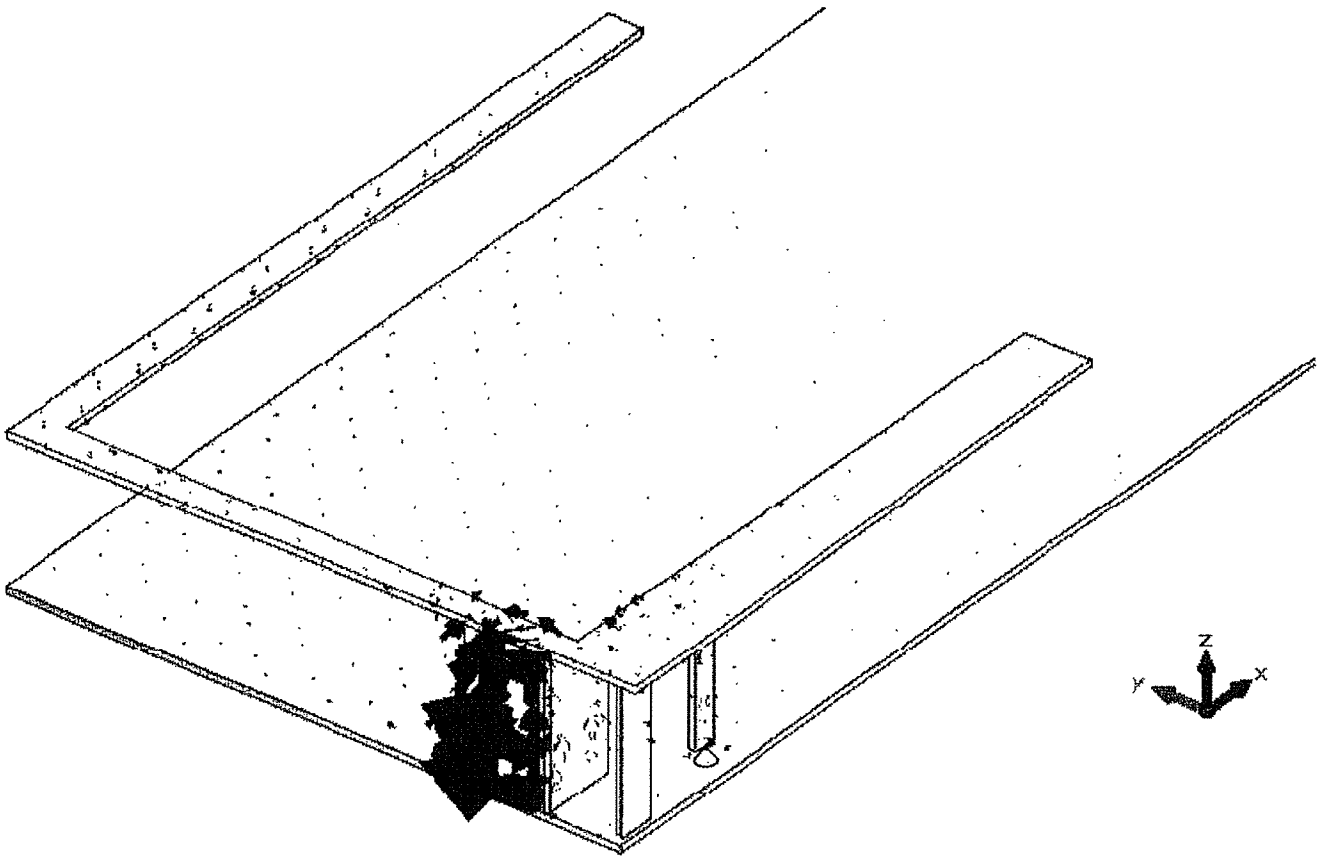
[FIG. 23]

FIGS. 20 to 23 illustrate simulation results of distribution of surface current (peak) in vector format in the exemplary PIFA. FIG. 20 illustrates distribution of surface current (peak) under the feed port P1 excitation at 950 MHz. FIG. 21 illustrates distribution of surface current (peak) under the feed port P2 excitation at 950 MHz. FIG. 22 illustrates distribution of surface current (peak) under the feed port P2 excitation at 1.95 GHz. FIG. 23 illustrates distribution of surface current (peak) under the feed port P1 excitation at 1.95 GHz.

Figure 5:
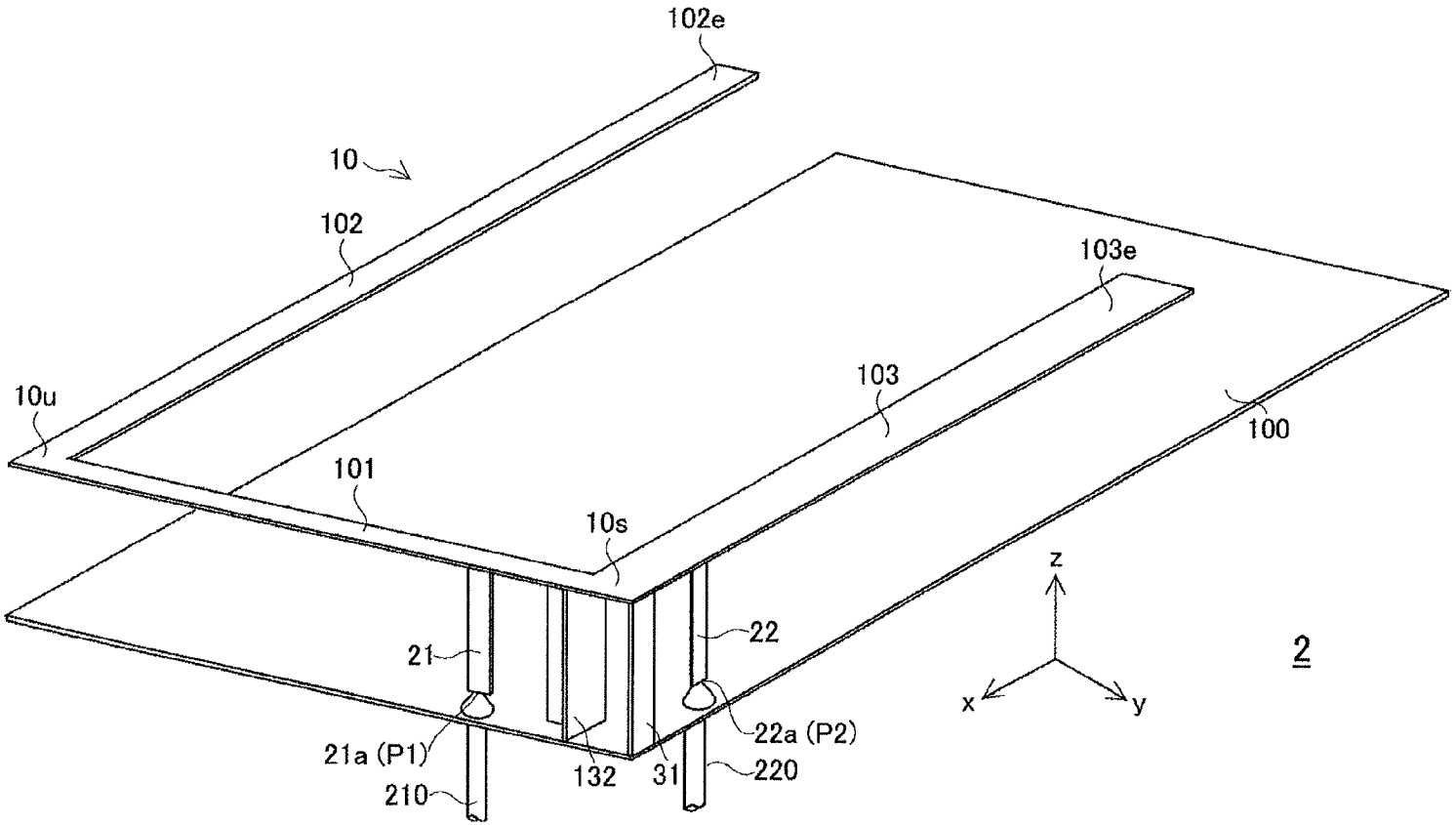
[FIG. 5]
Figure 6:
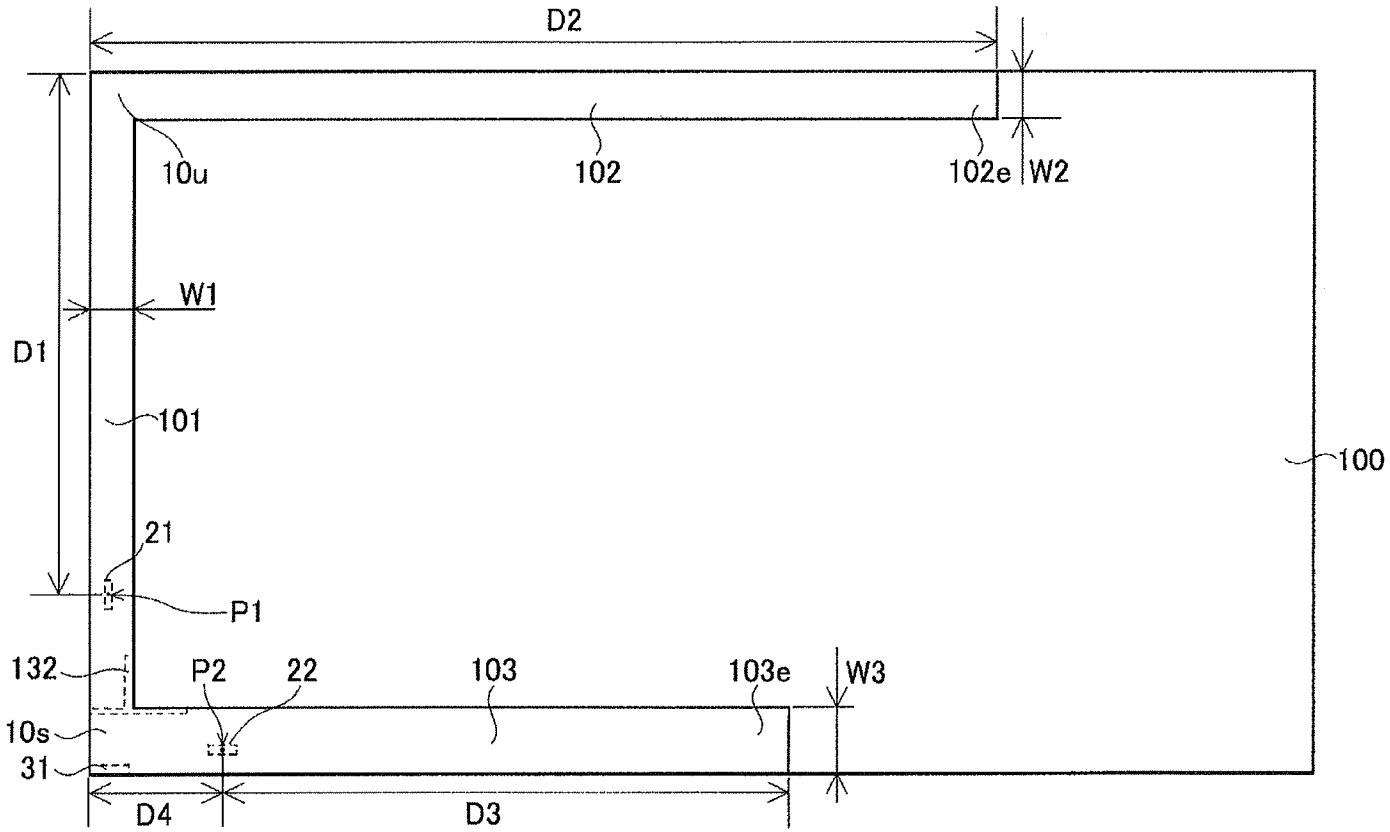
[FIG. 6]

As illustrated in FIG. 20, ample current flows on the surface of the first part 101 and the second part 102 of the radiating element 10 (refer also to FIG. 5). This means that a PIFA element, which is comprised of: the first part 101 and the second part 102 of the radiating element 10; the first feed element 21; and the first shorting element 31 (refer to FIG. 5), operates well at 950 MHz. As illustrated in FIG. 22, ample current flows on the surface of the third part 103 of the radiating element 10 (refer also to FIG. 5). This means that a PIFA element, which is comprised of: the third part 103 of the radiating element 10; the second feed element 22; and the second shorting element 132 (refer to FIG. 5), operates well at 1.95 GHz.

As illustrated in FIG. 21, when the feed port P2, which is intended to operate at the high resonant frequency band (1.95 GHz band), is excited at 950 MHz, very low level of current flows on the surface of the radiating element 10, since current is shorted from the feed port P2 to the ground plane 100, through the second feed element 22, the third part 103 of the radiating element 10, and the first shorting element 31. As illustrated in FIG. 23, when the feed port P1, which is intended to operate at the low resonant frequency band (950 MHz band), is excited at 1.95 GHz, very low level of current flows on the surface of the radiating element 10, since current is shorted from the feed port P1 to the ground plane 100, through the first feed element 21, the first part 101 of the radiating element 10, and the second shorting element 132. In view of the above, it is understood that the exemplary PIFA has achieved a good level of separation between the feed ports.

Although radiation characteristics and isolation between the ports have been discussed with references to the exemplary PIFA according to the second embodiment, the same applies to the PIFA according to the other embodiments having similar designs to that of the second embodiment.

All examples and conditional language used herein are intended for explanatory purposes to aid the readers in understanding the invention and the concepts contributed by the inventor to furthering the art, and are not to be construed as limiting the scope of the invention to such specifically described examples and conditions, nor does the organization of such examples in the specification relate to a showing of the superiority and inferiority of the invention. Although the embodiment(s) of the present invention have been described in detail, it should be understood that various changes, substitutions, and alternations could be made hereto without departing from the spirit and scope of the invention.

REFERENCE SIGNS LIST

100 ground plane
10 radiating element
101 first part of radiating element
102 second part of radiating element
103 third part of radiating element
102*e*, 103*e* free end of radiating element
10*s* first corner of radiating element
10*u* second corner of radiating element
21 first feed element
22 second feed element
31, 231 first shorting element
32, 132, 232 second shorting element
P1 first feed port
P2 second feed port

The invention claimed is:

1. A planar inverted-F antenna comprising:

a ground plane;

a radiating element spaced from the ground plane and extending substantially parallel thereto, the radiating element having substantially a U-shape including a first part, a second part, and a third part, the first part extending from a first corner of the radiating element to a second corner of the radiating element, the second part extending from the second corner to a free end of the radiating element, the third part extending from the first corner to the other free end of the radiating element;

first and second shorting elements located at the first corner of the radiating element or adjacent area thereof, the first and second shorting elements electrically connecting the radiating element to the ground plane;

a first feed port electrically connected to the first part of the radiating element, the first feed port being spaced from the first shorting element; and a second feed port electrically connected to the third part of the radiating element, the second feed port being spaced from the second shorting element.

2. The planar inverted-F antenna according to claim 1, wherein:

the first shorting element comprises a first strip that is located beneath the radiating element at an outer edge of the first corner or adjacent area thereof, the first strip is arranged to be parallel to the third part of the radiating element; and the second shorting element comprises a second strip that is located beneath the radiating element substantially at the first part adjacent to the first corner of the radiating element, the second strip is arranged to be parallel to the first part of the radiating element.

3. The planar inverted-F antenna according to claim 2, wherein:

the second shorting element further comprises a third strip that is located beneath the radiating element, the third strip being attached to and positioned perpendicular to the second strip, the third strip is arranged to be parallel to the third part of the radiating element.

4. The planar inverted-F antenna according to claim 1, wherein:

the first shorting element comprises a fourth strip that extends substantially from an inner edge, at which the first part and the third part of the radiating element intersect, over the width of the first part of the radiating element; and the second shorting element comprises a fifth strip that extends from said inner edge over the width of the third part of the radiating element, the fifth strip being attached to the fourth strip.

5. The planar inverted-F antenna according to any of claims 1 to 4, wherein:

at least one of the second part and the third part of the radiating element is bent such that at least one of the free ends faces inward with respect to the U-shape.

* * * * *